United States Patent [19]

Nagano et al.

[11] Patent Number: 5,043,770

[45] Date of Patent: Aug. 27, 1991

[54] IMAGE FORMING APPARATUS

[75] Inventors: Toshiyuki Nagano; Naomasa Kimura, both of Yokohama, Japan

[73] Assignee: Canon Kabushiki Kaisha, Tokyo, Japan

[21] Appl. No.: 618,588

[22] Filed: Nov. 28, 1990

Related U.S. Application Data

[63] Continuation of Ser. No. 462,452, Jan. 9, 1990, abandoned.

[30] Foreign Application Priority Data

Jan. 10, 1989 [JP] Japan ..... 1-004149
Mar. 28, 1989 [JP] Japan ..... 1-075874
Jun. 15, 1989 [JP] Japan ..... 1-154055

[51] Int. Cl.[5] ..... G03G 21/00

[52] U.S. Cl. ..... 355/311; 355/309; 355/75; 355/316; 271/9

[58] Field of Search ..... 355/316, 309, 308, 311, 355/318, 319, 200, 210, 305, 208, 23, 24, 75; 271/9, 225, 301

[56] References Cited

U.S. PATENT DOCUMENTS 4,209,249 1/1980 Clark et al. ..... 271/9 X
4,337,935 7/1982 Sawada et al. ..... 271/9
4,412,743 11/1983 Shibuya et al. .
4,483,528 11/1984 Takeyama et al. ..... 271/9
4,549,805 10/1985 Itmori .
4,636,057 1/1987 Iida et al. .
4,672,465 6/1987 Ono .
4,685,792 8/1987 Iseki et al. .
4,734,738 3/1988 Yamanaka et al. ..... 271/9 X
4,791,457 12/1988 Shida .
4,849,790 7/1989 Ito et al. ..... 271/9 X
4,943,828 7/1990 Manabe ..... 355/200
4,956,678 9/1990 Kiya et al. ..... 355/318

*Primary Examiner*—R. L. Moses
*Attorney, Agent, or Firm*—Fitzpatrick, Cella, Harper & Scinto

[57] ABSTRACT

The present invention provides an image forming apparatus having an image forming portion, means for feeding a sheet material to the image forming portion and a re-feeding path for re-feeding the sheet on which an image is formed at the image forming portion to the image forming portion again. The image forming apparatus comprises a manual sheet feed inlet formed in the front side of said image forming apparatus; a manual sheet insertion path for directing a sheet material manually inserted into the manual sheet feed inlet to the re-feeding path, the manual sheet insertion path being arranged substantially perpendicular to the re-feeding path; and a feeding means for feeding the manually inserted sheet material directed to the re-feeding path to the image forming portion.

16 Claims, 20 Drawing Sheets

210
210a
220
219
211
218
209
215
212
217
216
211a
209a
222a
231
226
C
223
232
203a
222
227
126
221
229
P
233a
233b
215a
212a

IMAGE FORMING APPARATUS

This application is a continuation of application Ser. No. 462,452 filed Jan. 9, 1990, now abandoned.

BACKGROUND OF THE INVENTION

1. Field of the Invention

The present invention relates to an image forming apparatus such as a copying machine, laser beam printer and the like, and more particularly, it relayes to an image forming apparatus (referred to as "copying machine" hereinafter) which includes a manual sheet feed device and a sheet re-feeding path.

2. Related Background Art

A copying machine including a manual sheet feed device and a sheet re-feeding path has been already known. As shown in FIG. 1, such conventional copying machine 1*a* has a machine frame 3 including a copying portion 2 therein, and includes a platen 5, a light source 6, mirrors 7–12, a lens 13, and two cassettes 15, 16 for accommodating sheets S therein. Sheet feed rollers 17 and 19 are arranged above the cassettes 15 and 16, respectively. A pair of separating/feeding rollers 21 are arranged downstream of the sheet feed roller 17, and a pair of separating/feeding rollers 21 are arranged downstream of the sheet feed roller 19. Further, a pair of regist rollers 22 are arranged downstream of the roller pairs 20, 21.

In addition, the copying portion 2 is situated downstream of the pair of regist rollers 22, and a feeding device 23 and a fixing device 25 are arranged downstream of the copying portion 2. A feeding roller 24, a flapper 26 and ejector rollers 27 are arranged downstream of the fixing device 25, and an ejector tray 29 is arranged downstream of the ejector rollers 27. Further, a sheet re-feeding path 30 is branched from the flapper 26, which sheet re-feeding path 30 includes pairs of feeding rollers 31, 32 and a pair of re-feeding rollers 33.

Further, the copying portion 2 includes a cylindrical photosensitive drum 42 around which an eraser lamp, a primary charger 45, a color developing device 46, a developing device 47, a transfer charger 49, a separating charger 50 and a cleaner 51 are arranged. A rockable manual sheet feed tray 52 is mounted on a side of the machine frame 2 above the cassette 15. Incidentally, in FIG. 1, the reference numerals 53, 55, 56 denote guide plates.

In case where a one-face or one side copying operation is performed, when a start key (not shown) is depressed, the sheet feed roller 17 or 19 is rotated to pick up the sheet S from the cassette 15 or 16. Then, the sheet S is fed by the pair of separating/feeding rollers 20 or 21 to the regist roller pair 22, and, thereafter, the sheet is fed by the regist rollers 22 to the photosensitive drum 42 in synchronous with an image formed on the photosensitive drum, where the image on the photosensitive drum 42 is transferred onto the sheet by means of the transfer charger 49. Then, the image transferred to the sheet S is fixed on the sheet by means of the fixing device 25. Thereafter, the sheet S is directed by the flapper 26 to the pair of ejector rollers 27 to be ejected on the ejector tray 29.

On the other hand, in case where a both-face copying operation or a multiple copying operation is performed, the sheet S on which the image is transferred in the same manner as mentioned above is directed by the flapper 26 to the sheet re-feeding path 30 through which the sheet is re-fed to the regist rollers 22. Then, the same sheet is subject to the second copying operation and is ejected onto the ejector tray 29.

When the manual sheet feed is effected, an operator opens the manual sheet feed tray 52 and supplies the sheet S along the manual sheet feed tray. In this case, the sheet S is introduced on the uppermost sheet in the cassette 15 and detected by a sensor (not shown). On the basis of a signal emitted from the sensor, the sheet feed roller 17 and separating/feeding rollers 20 are rotated to feed the manually fed sheet S to the regist rollers 22. Thereafter, the manually fed sheet S is subject to the copying operation and is ejected to the ejector tray 29 in the same manner as mentioned above.

By the way, in the above-mentioned conventional copying machine 1*a*, since the manual sheet feed tray 52 is situated on the right side of the machine frame 3, when the manually fed sheet S is supplied to the manual sheet feed tray 52, it is necessary to maintain an adequate space at the right side of the machine frame 3, thus preventing the saving of the space.

In order to eliminate this drawback, Applicant has proposed a copying machine in which the manually fed sheet can be inserted at a front side of the copying machine.

However, if such copying machine includes the sheet re-feeding path for the both-side copying operation and the multiple copying operation, the addition of the manual sheet feed device makes the copying machine large-sized.

SUMMARY OF THE INVENTION

The present invention aims to eliminate the drawbacks of the conventional copying machines, and an object of the present invention is to provide a compact image forming apparatus including a manual sheet feed device.

In order to achieve the above object, the present invention provides an image forming apparatus including a sheet re-feeding path for re-feeding a sheet on which an image has been formed to an image forming means, and wherein a manual sheet feed inlet is formed in the front side of the copying machine, a manual sheet feed device is arranged in the sheet re-feeding path, and the manually fed sheet inserted from the manual sheet feed inlet is fed by means of the manual sheet feed device to a direction perpendicular to a manually feeding direction.

According to the present invention, since the manual sheet feed device is arranged in the sheet re-feeding path and the manual sheet feed device feeds the sheet in the direction perpendicular to the manually feeding direction, it is possible to insert and feed the manually fed sheet from the front side of the copying machine without making the machine large-sized.

Further, according to the invention, by permitting the judgement whether the inserted sheet can be fed or not, through detection of a width of the manually fed or inserted sheet by means of a detection means arranged in a manually fed sheet feeding path, it is possible to prevent occurrence of the jamming of the sheet, for example, by inserting a sheet having a width narrower than a pitch between sheet feeding rollers in a first sheet feeding path.

Further, by permitting the ejection of the manually fed sheet by means of an ejector means when the abnormity occurs during the feeding of the manually inserted sheet, the jamming of the sheet can be prevented, thus avoiding the troublesome recovery operation for removing the jammed sheet.

DESCRIPTION OF THE PREFERRED EMBODIMENTS

The present invention will now be explained in connection with embodiments thereof with reference to the accompanying drawings.

Figure 14:
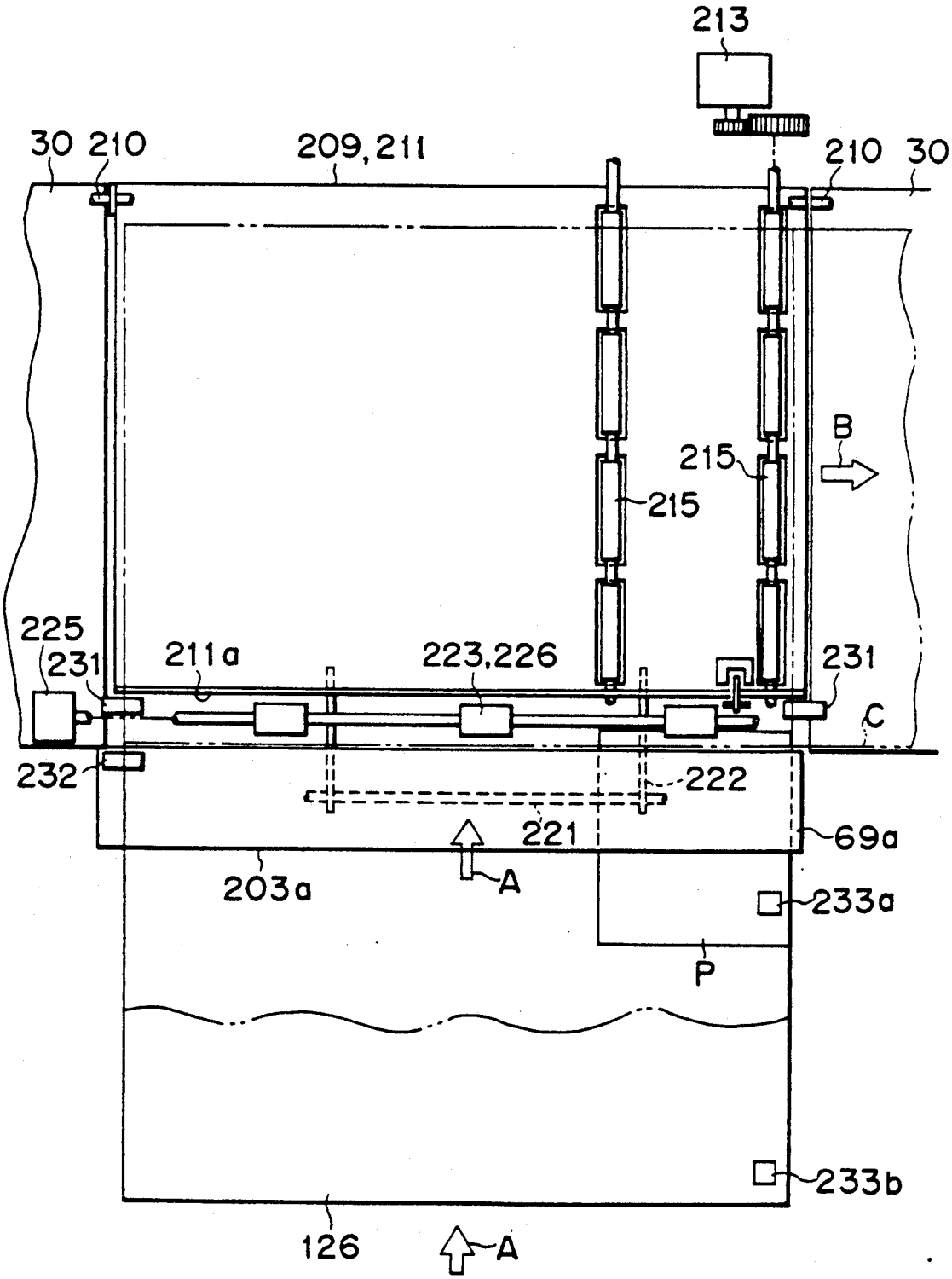
FIG. 14 is a plan view of a front manual sheet feed device.

FIG. 14 shows a plan view of a front manual sheet feed device, and FIG. 15 is a view for explaining the operation of the front manual sheet feed device.

Incidentally, the same constructural elements as already described in connection with the conventional machine are designated by the same reference numerals as used in the description of the, conventional machine, and the detailed explanation thereof will be omitted.

Figure 1:
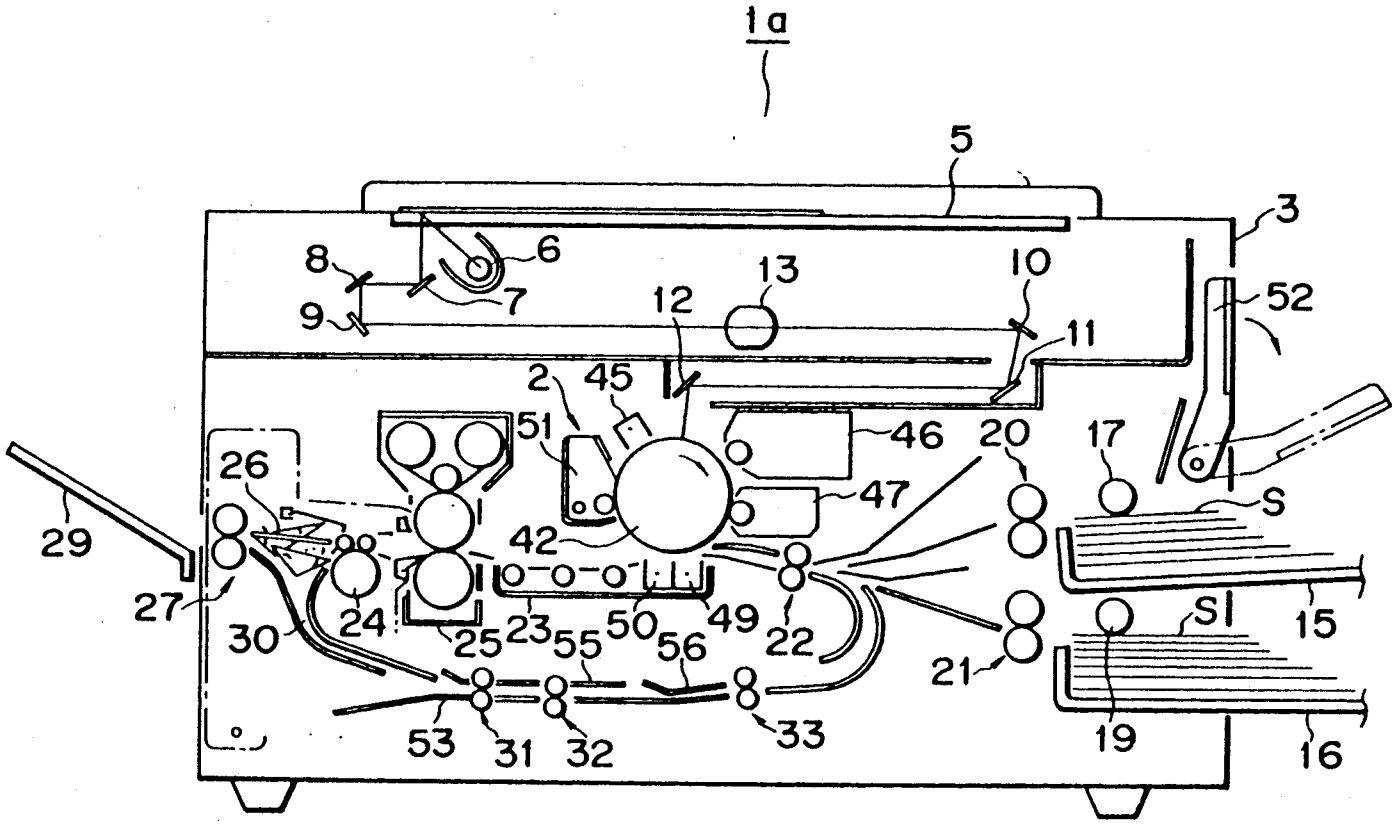
FIG. 1 PRIOR ART
FIG. 1 is a schematic sectional elevational view of a conventional image forming apparatus.
Figure 2:
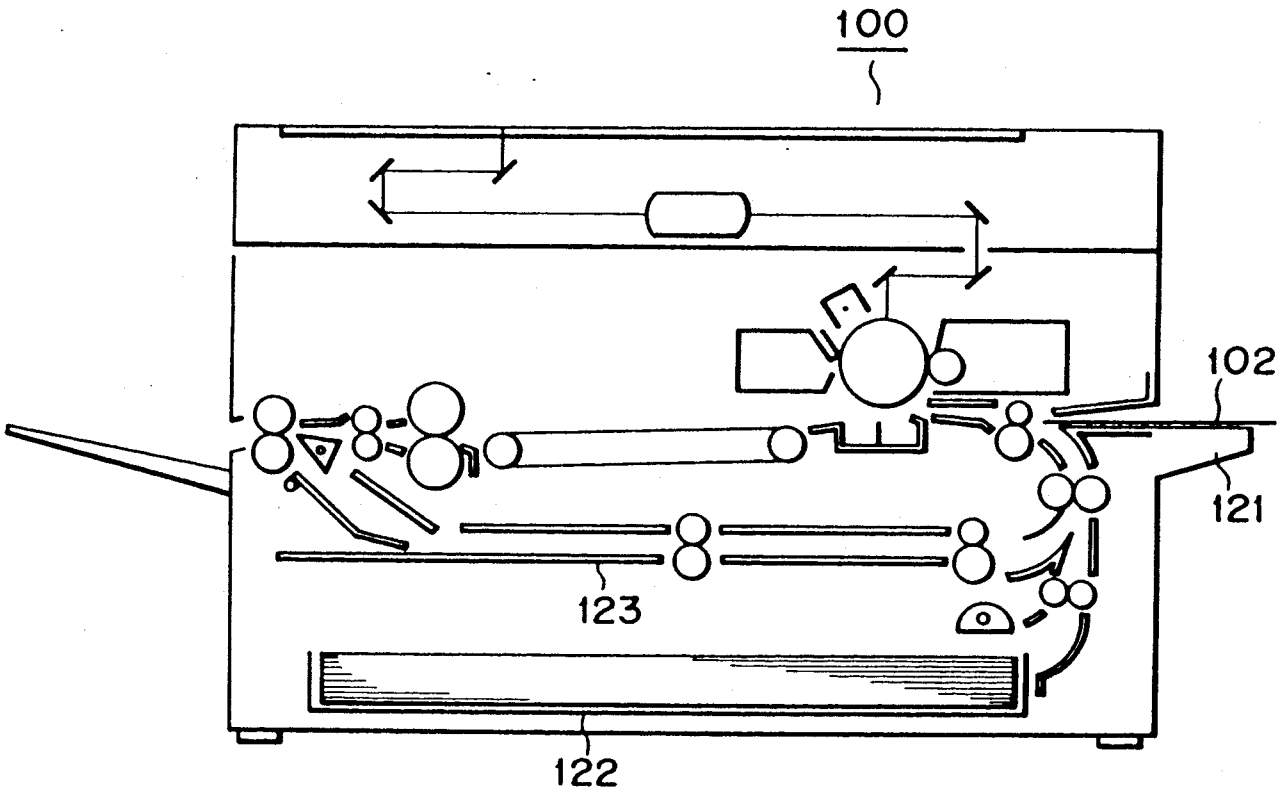
FIG. 2 PRIOR ART
FIG. 2 is a schematic sectional elevational view of another conventional image forming apparatus.
Figure 3:
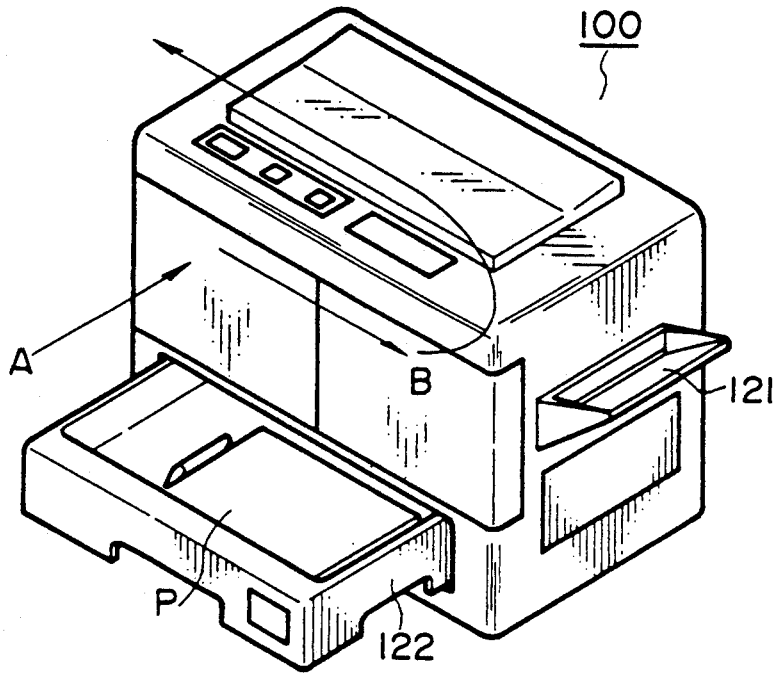
FIG. 3 PRIOR ART
FIG. 3 is a perspective view of the apparatus of FIG. 2.
Figure 4:
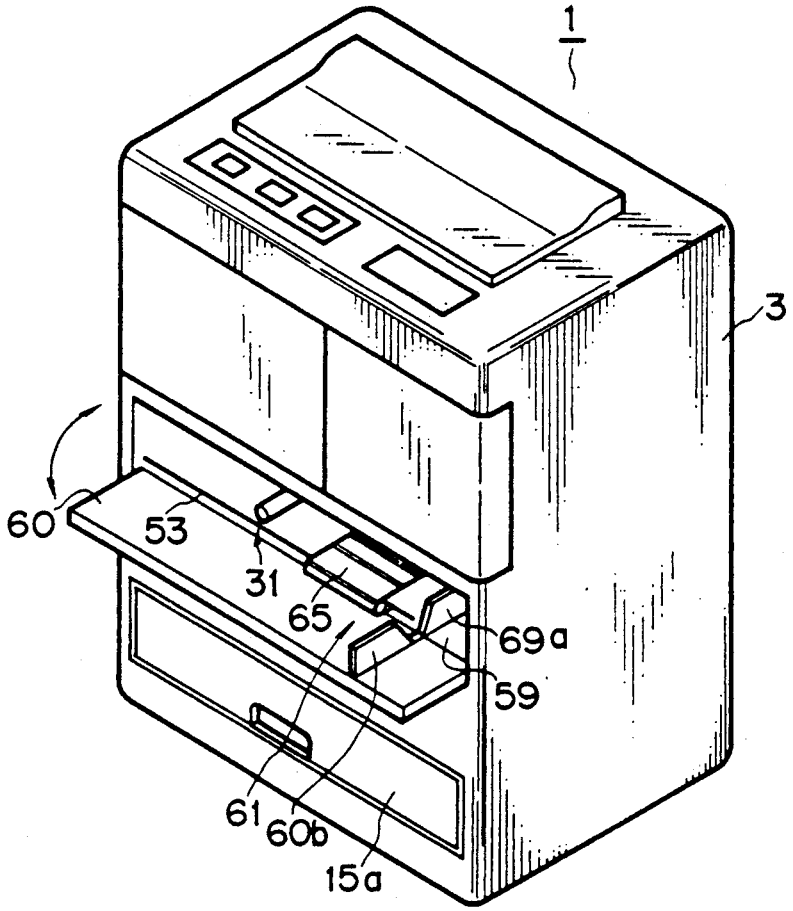
FIG. 4 is a perspective view of an image forming apparatus according to an embodiment of the present invention.
Figure 5:
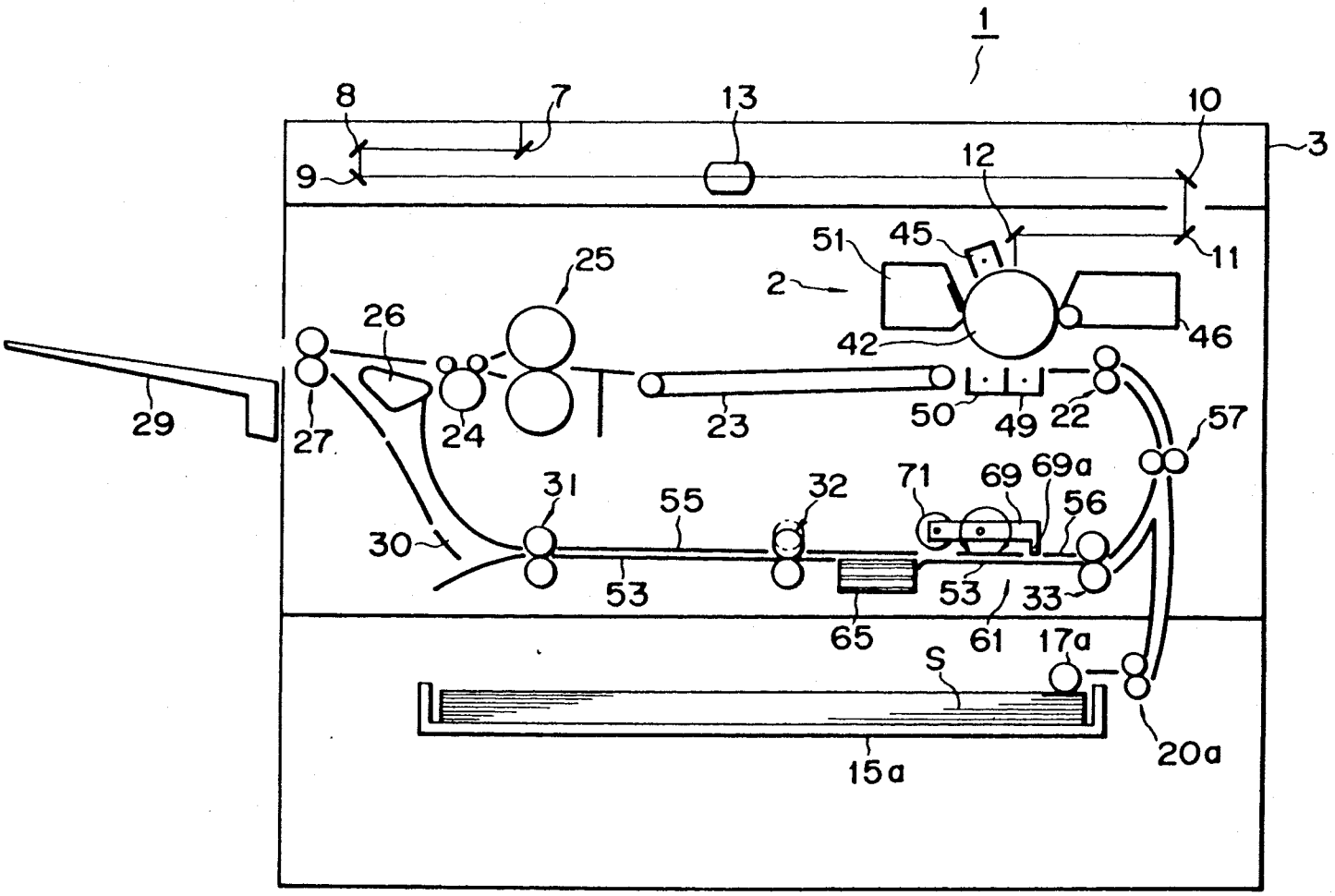
FIG. 5 is a schematic sectional elevational view of the apparatus of FIG. 4.

As shown in FIGS. 4 and 5, a copying machine 1 includes a cassette 15*a* which is removably mounted within a machine frame 3 and on which a sheet feed roller 17*a* is rotatably mounted. Downstream of the sheet feed roller 17*a*, a pair of separating/feeding rollers 20*a* for separating and feeding sheets S are arranged. A pair of feeding rollers 57 are arranged downstream of the separating/feeding rollers 20*a*. Further, a manual sheet feed inlet 59 is formed in a front side of the machine frame 3, and a rockable or openable cover 60 normally closes the inlet 59. The reference numeral 60*b* denotes a guide plate for a sheet to be manually fed. At the rear of the manual sheet feeding inlet 59 and in a sheet re-feeding path 30, a manual sheet feed device 61 for feeding the manually inserted sheet S is arranged.

Figure 6:
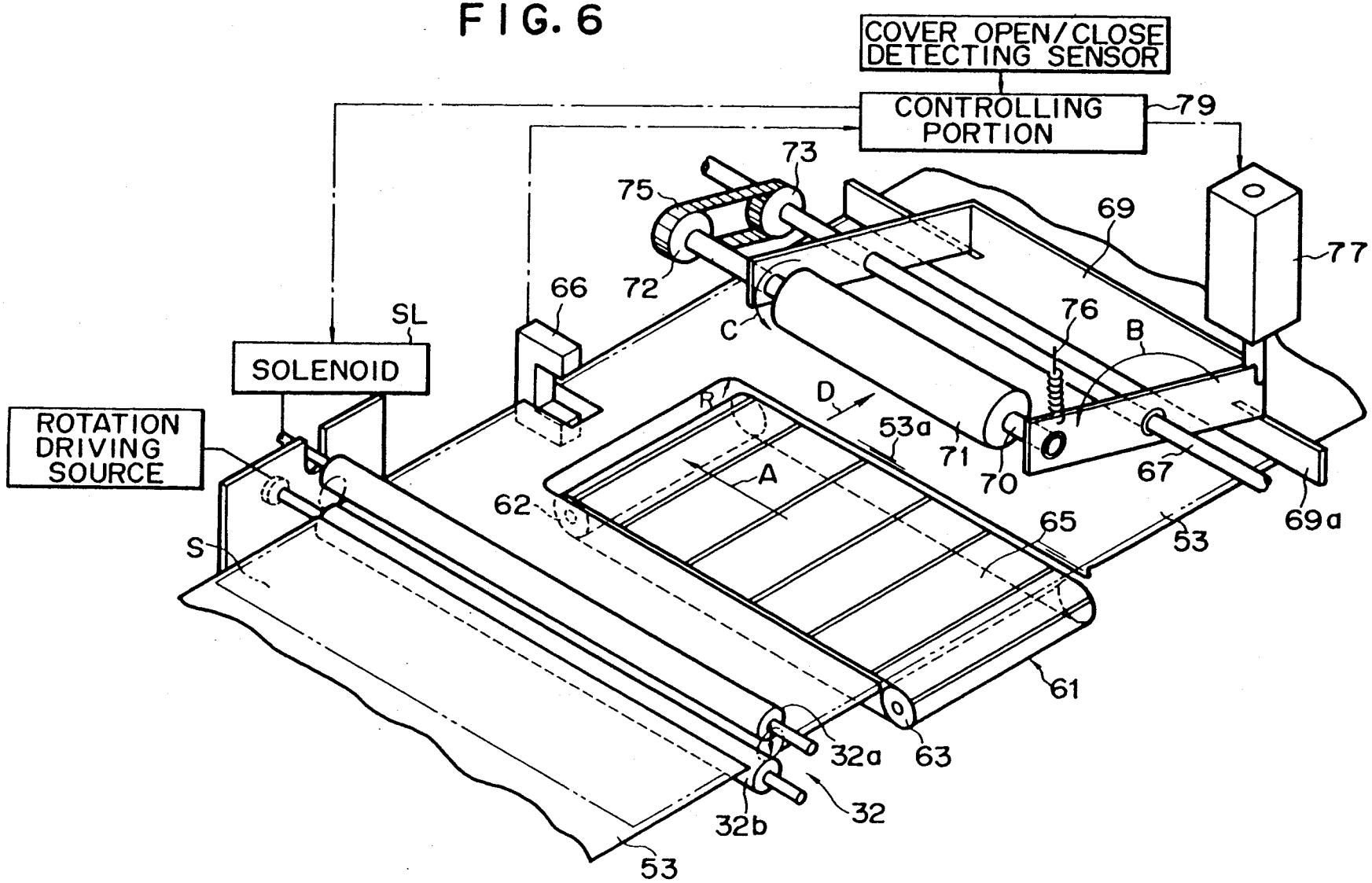
FIG. 6 is a perspective view showing a main portion of the apparatus of FIG. 4.

As shown in FIG. 6, the manual sheet feed device 61 has a driven roller 62 driven by a driving means (not shown) comprising a belt and a driving motor, an idle roller 63, and a conveyor belt 65 extending between and entrained by these rollers 62, 63. The conveyor belt 65 is adapted to feed the manually inserted sheet S rearwardly in a direction shown by the arrow A. Incidentally, an upper surface of the conveyor belt 65 is situated slightly below an upper surface of a lower guide plate 53. An edge surface 53*a* of the lower guide plate 53 is curved downwardly and a corner thereof is rounded (by R) so that the sheet is not blocked by the lower guide plate. A sheet end detecting sensor 66 for detecting the leading edge of the sheet is arranged in the vicinity of the rear end of the conveyor belt 65.

At a right side of the conveyor belt 65, a shaft 67 is rotatably supported by the machine frame 3, which shaft is connected to a motor (not shown). In addition, the shaft 67 has a liad U-shaped support plate 69 rotatably supported thereby, which support plate 69 rotatably supports a shaft 70. The shaft 70 has a feeding roller 71 fixed thereto and also has one end to which a pulley 72 is fixedly attached. On the shaft 67, a pulley 73 is fixed in confronting relation to the pulley 72, and a belt 75 is extended between and entrained by these pulleys 72, 73.

Further, the support plate 69 is biased toward a clockwise direction by a spring having one end connected to the free end of the support plate 69 and the other end connected to the machine frame 3. When a solenoid 77 connected to the base of the support plate 69 is turned ON, the support plate 69 is rocked in a direction shown by the arrow B The base end of the support plate 69 has an extension 69*a* extending vertically and laterally to form a side regulating plate 69*a* for regulating the side of the manually inserted sheet S.

A pair of feeding roller 32 is so designed that, when the cover 60 is opened, an upper roller 32*a* thereof is separated away from a lower roller 32*b* thereof by means of a solenoid SL. The sheet end detecting sensor 66, solenoid 77 and solenoid SL are connected to a controlling portion 79. Incidentally, the support plate 69 is normally held stationary by abutting against the closed cover 60 with a sheet passage clearance (FIG. 5) formed between the side regulating plate 69*a* and the lower guide plate 53.

According to the illustrated embodiment, with the arrangement as mentioned above, when the manually inserted sheet S is fed, an operator firstly opens the cover 60. A cover open/close detecting sensor (not numbered in FIG. 6) detects the opening of the cover 60 and outputs a signal to the controlling portion 79. The controlling portion 79 energizes the solenoid SL to lift the upper roller 32*a* of the roller pair 32 away from the lower roller 32*b*. Then, the operator introduces the sheet S manually onto the guide plate 53 along the side regulating plate 69*a* (which has been unlocked by the opening of the cover 60 and has slightly been turned in the clockwise direction to abut against the lower guide plate 53, thus being held stationary). When the operator depresses a copy button (not shown), the conveyor belt 65 is turned or rotated by the belt driving motor to feed the sheet S in the direction A (FIG. 6).

Incidentally, in this case, the left side portion of the sheet S is introduced between the separated upper and lower rollers 32*a*, 32*b*. When the leading edge of the sheet S is detected by the sheet end detecting sensor 66, the belt driving motor is turned OFF to stop the conveyor belt 65. In this way, the leading edge of the sheet S is positioned along a reference.

When a predetermined time is elasped after the sensor 66 has detected the sheet, the solenoid 77 is turned ON, thus turning or rotating the support plate 69 in the direction B (FIG. 6) in opposition to the force of the bias spring 76. The rotation of the support plate 69 causes the side regulating plate 69*a* to lift to unlock this regulating plate and also causes the feeding roller 71 to rock in the direction B to abut against the sheet S. At the same time or immediately after the feeding roller 71 has abutted against the sheet S, a driving force from a driving means (not shown) is transmitted to the feeding roller 71 through the shaft 67, pulley 71, belt 75, pulley 72 and shaft 70, whereby the feeding roller 71 is rotated in a direction shown by the arrow C (FIG. 6).

Consequently, the manually introduced sheet S is fed in a direction shown by the arrow D (FIG. 6), and then is fed to a pair of regist rollers 22 by means of pairs of feeding rollers 33, 57. Thereafter, the sheet S is subject to the copying operation and then is ejected onto an ejector tray 29 in the same manner as previously mentioned. When the feeding of one sheet has been completed, the solenoid 77 is turned OFF by a completion signal (such as copy completion signal), the feeding roller 71 is lifted, and the side regulating plate 69*a* is lowered, thus preparing for the next sheet.

When the operator closes the cover 60 after the manual sheet feed operation has been finished, the cover open/close detecting sensor (not shown) detects the closure of the cover 60 and outputs a signal to the controlling portion 79. Then, the controlling portion deenergizes the solenoid SL. Consequently, the upper roller 32*a* of the roller pair 32 is lowered to contact the lower roller 32*b* again. On the other hand, the support plate 69 is lifted by the member lifted in response to the closure of the cover 60, and is rocked in an anti-clockwise direction in opposition to the force of the spring 76 until the side regulating plate 69*a* is positioned substantially in horizontal with a lower guide plate 56. In this way, the sheet to be re-fed can be re-fed without contacting the side guide plate 69*a*. Incidentally, when the sheet is re-fed, the feeding roller 71 may also be used as a re-feeding roller if the size of the sheet is small.

Figure 7:
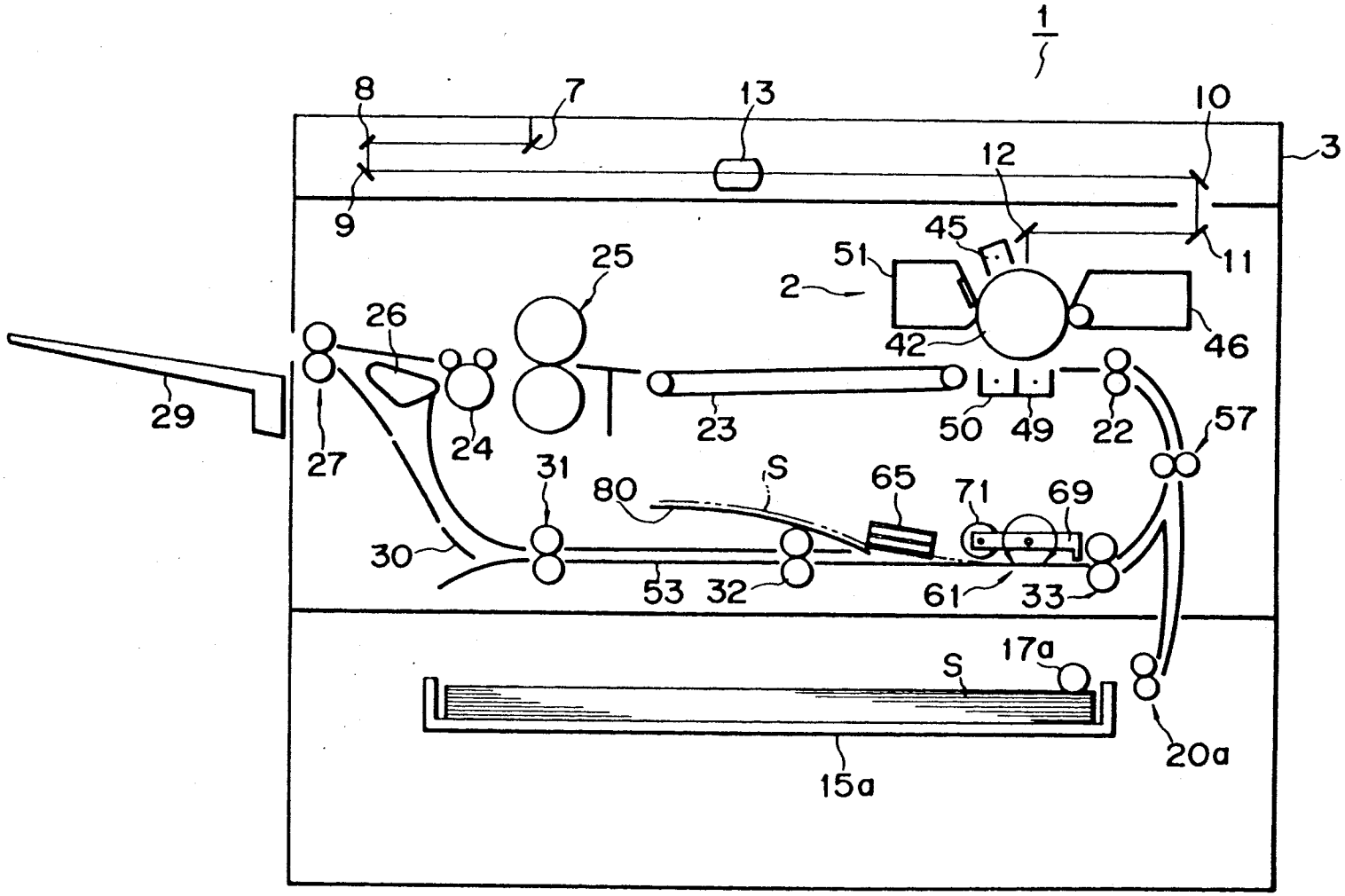
FIGS. 7 and 8 are schematic sectional elevational views of an image forming apparatus according to other embodiments of the present invention.

Incidentally, in the illustrated embodiment, while an example that the upper roller 32*a* of the roller pair 32 is separated from the lower roller 32*b* and the left side portion of the sheet S is introduced between the upper and lower rollers 32*a*, 32*b* was explained, the present invention is not limited to this example. For example, as shown in FIG. 7, a manual sheet feed tray 80 may be arranged above the pair of feeding rollers 32 and the left side portion of the manually inserted sheet may be positioned on the tray 80. In this case, the solenoid SL for shifting the upper roller 32*a* can be omitted, thus making the whole machine inexpensive.

Incidentally, in the illustrated embodiment, when it is desired perform the both-face copying operation and the multiple copying operation with the manually fed sheet, the support plate 69 is so constructed that it is electrically held in two different positions (to change the energization of the solenoid). That is to say, it is so designed that, when the sheet is manually introduced, the feeding roller 71 is lifted and the side regulating plate 69*a* is lowered in its lowermost position, and that, when the sheet is fed, the feeding roller 71 is lowered and the side regulating plate 69*a* is lifted, and that, when the sheet is re-fed, the feeding roller 71 is slightly lifted and the side regulating plate 69*a* is also slightly lifted.

Of course, in another embodiment, the side regulating plate 69*a* may be used as a sheet registrating member (for stopping the sheet temporarily) when the sheet is re-fed. In this case, the side regulating plate 69*a* may be positioned at its lowermost position when the cover 60 is closed.

Figure 8:
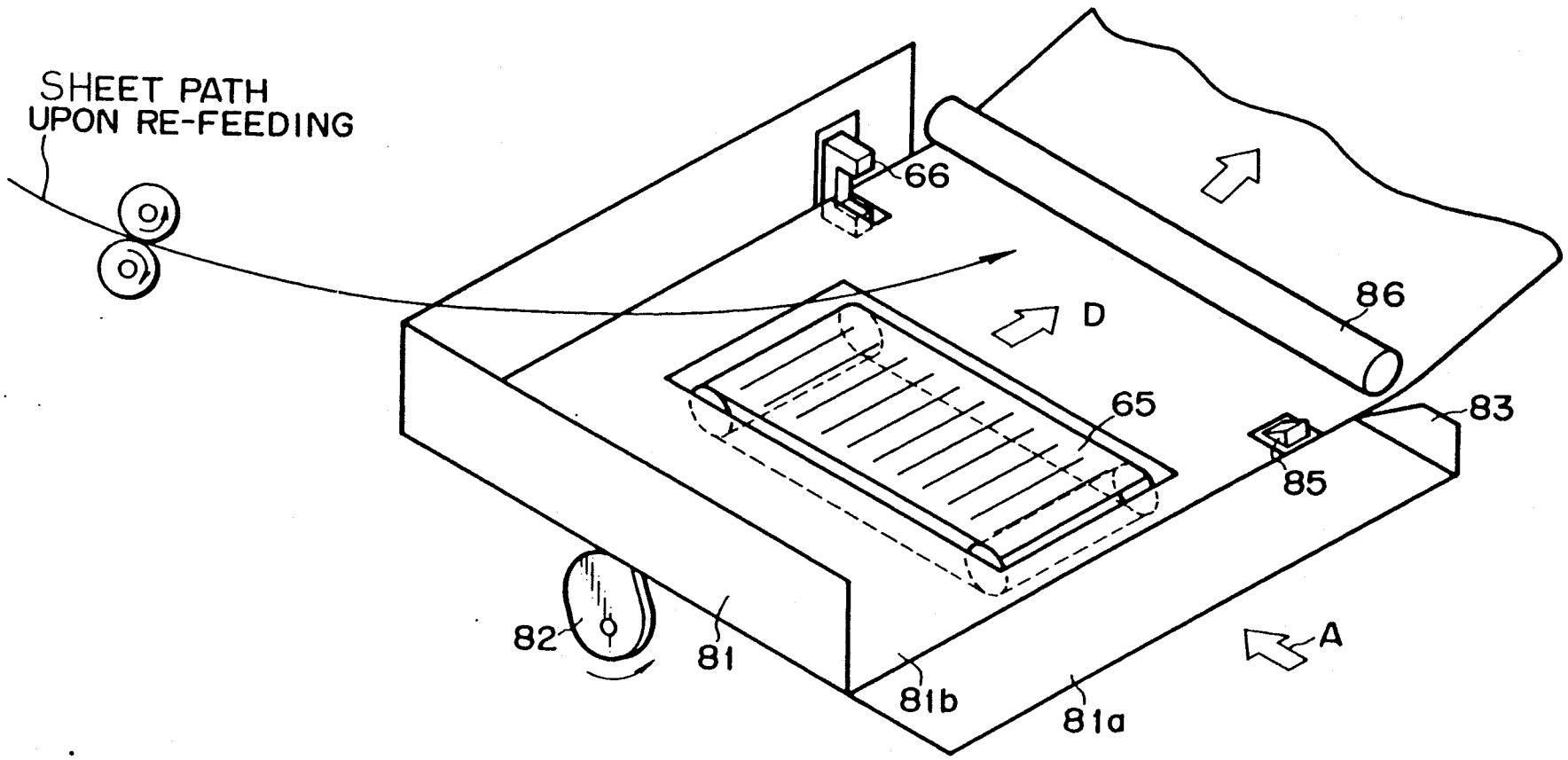

Next, a further embodiment wherein a copying machine includes an intermediate tray arranged in the sheet re-feeding path will be explained with reference to FIG. 8.

The intermediate tray 81 is supported at its left side portion by a cam 82 and can be lifted and lowered in response to the rotation of the cam 82. A front side plate 81*a* of the tray 81 is supported by the tray 81 for open and close movement with respect to the tray. When the front side plate 81*a* is opened, the side plate 81*a* is supported in a position where it is substantially flush with a bottom plate 81*b* of the tray 81. Further, a manual sheet feed guide 83 is arranged at the right end of the front side plate 81*a*, which guide extends uprightly from the side plate 81*a*. A manual sheet detecting sensor 85 for detecting the manually introduced sheet is arranged at a front portion of the right side of the bottom plate 81*b*. Incidentally, in FIG. 8, the reference numeral 86 denotes a sheet re-feeding roller for re-feeding the sheet S.

When the manually inserted sheet S is fed, the operator opens the cover of the front portion of the machine frame and also opens the front side plate 81*a* of the intermediate tray 81. Then, when the operator inserts the sheet manually along the manual sheet feed guide 83 in a direction shown by the arrow A, the sheet S is detected by the manual sheet detecting sensor 85 so that the sensor emits a signal. In response to this signal, a driving means rotates a conveyor belt 65.

The manually inserted sheet S is then fed rearwardly by means of the rotating conveyor belt 65. When the leading edge of the sheet is detected by a sheet end detecting sensor 66, the sensor 66 emits a signal. In response to this signal, the conveyor belt 65 is stopped, and, at the same time, the cam 82 is rotated by a driving means (not shown). By the rotation of the cam 82, the intermediate tray 81 is inclined so that the left side thereof becomes higher than the right side thereof and the bottom plate 81*b* becomes higher than the conveyor belt 65. In consequence of the inclination of the intermediate tray 81, the manually inserted sheet S is slid on the tray 81 to abut against the re-feeding roller 86, thereby re-feeding the sheet. Thereafter, the sheet S is is subject to the copying operation and is then ejected onto the ejector tray 29 in the same manner as mentioned above. Incidentally, if the sheet is not manually introduced, the sheet is introduced or dropped onto the tray 81 from the above.

Figure 9:
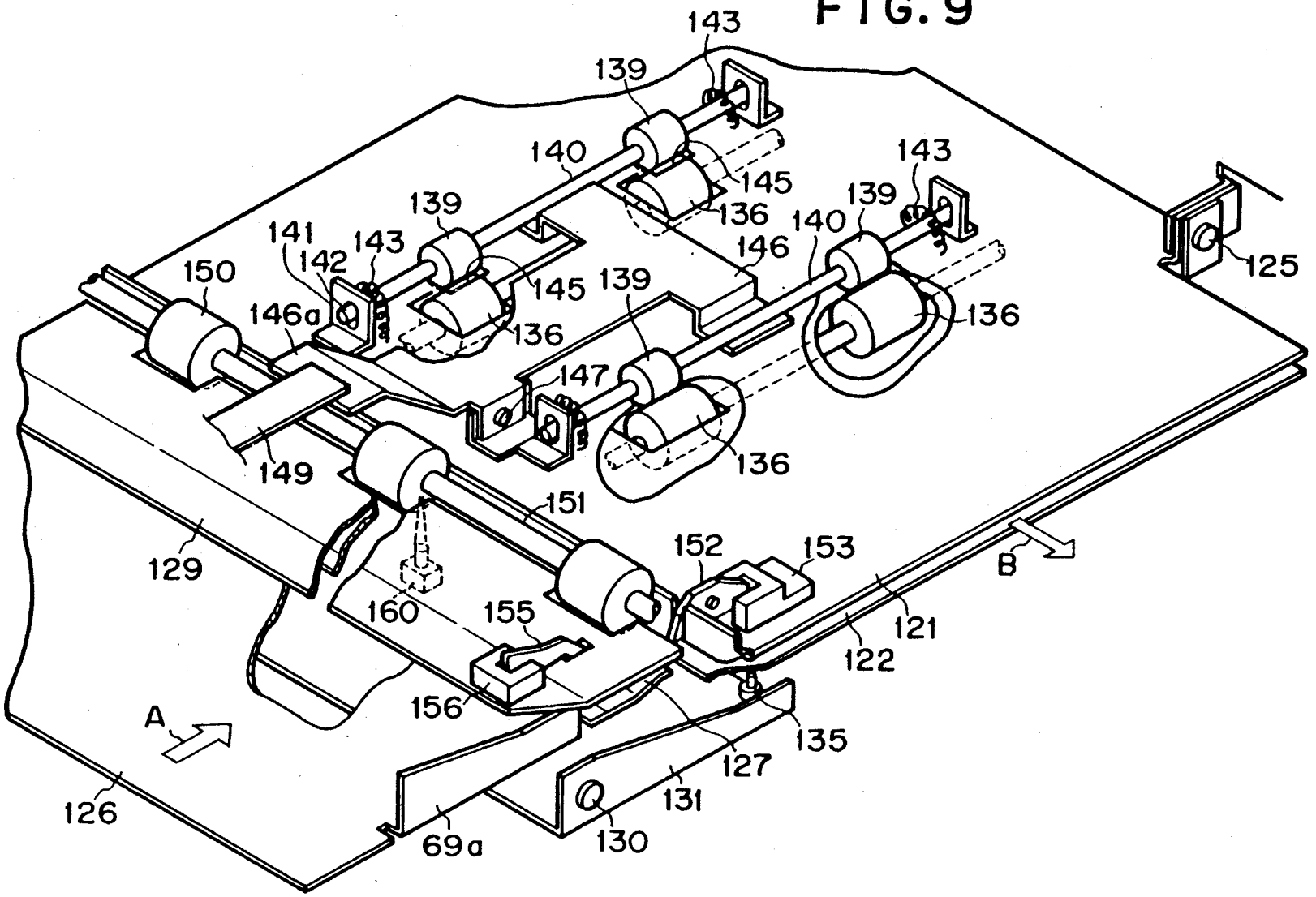
FIG. 9 is a perspective view of an image forming apparatus according to a further embodiment of the present invention.
Figure 10:
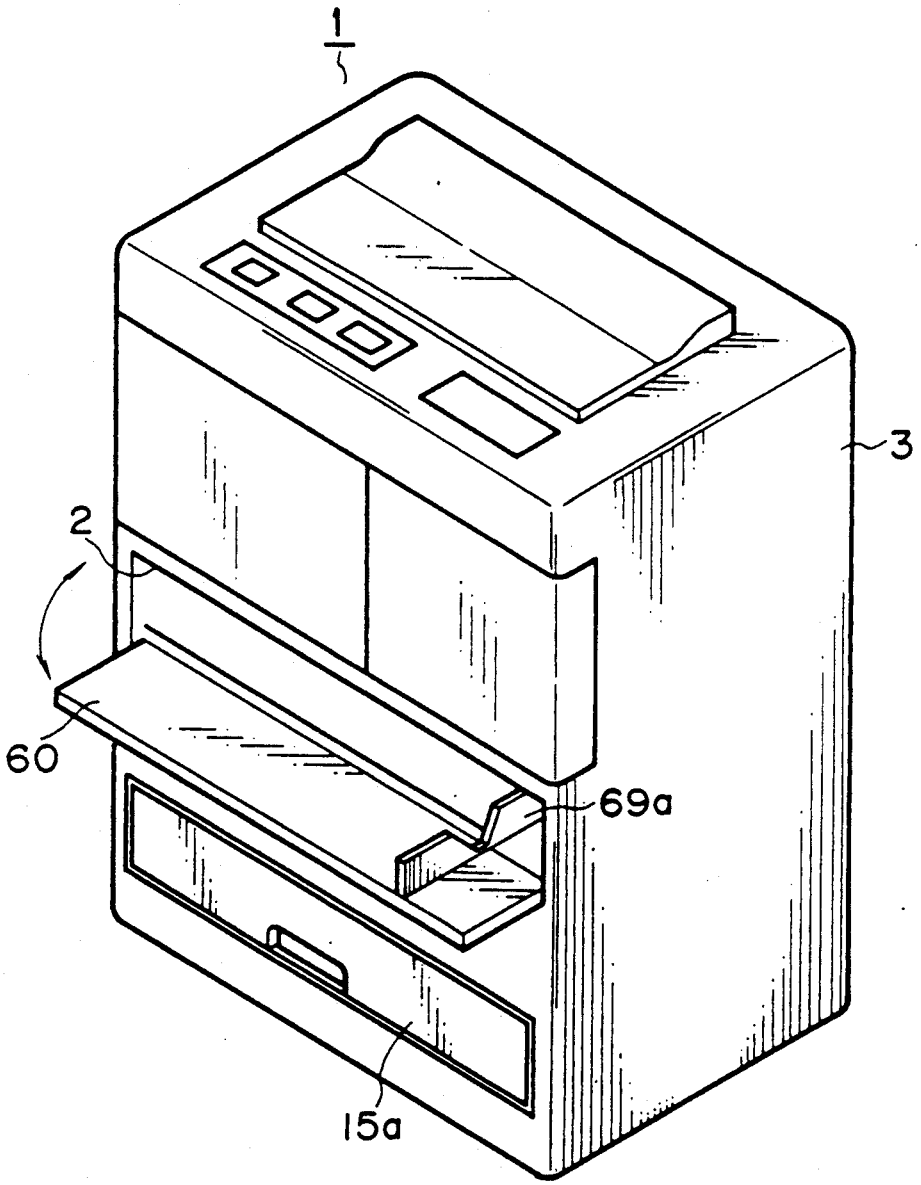
FIG. 10 is a perspective view of a copying machine to which the present invention is applied.
Figure 11:
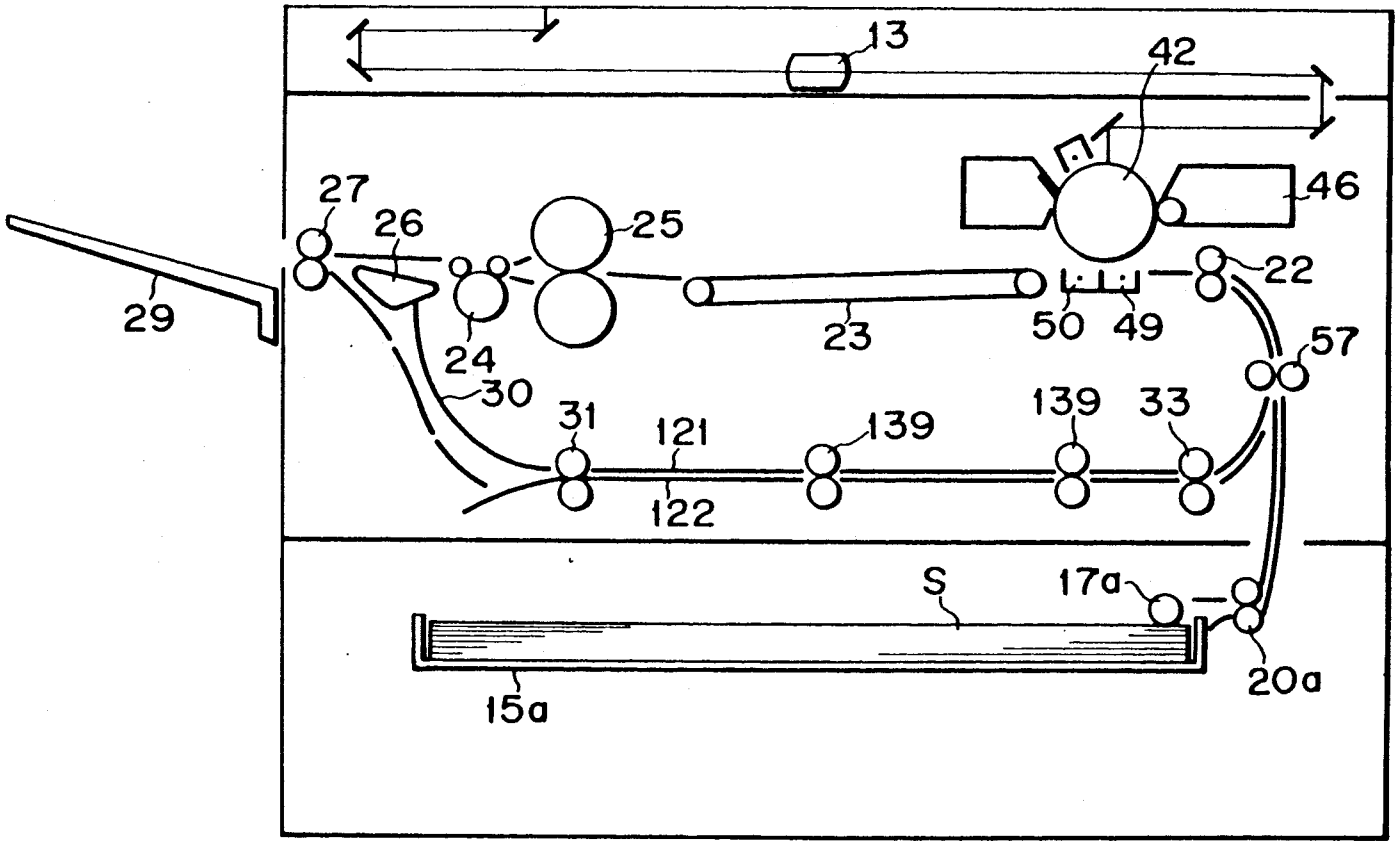
FIG. 11 is a schematic sectional elevational view of the machine of FIG. 10.

Next, a further embodiment of the present invention will be explained with reference to FIGS. 9 to 13. FIG. 9 is a perspective view of a main portion of a copying machine according to this embodiment, FIG. 10 is a perspective view of the whole copying machine, FIG. 11 is a sectional elevational view of the copying machine of FIG. 10, FIG. 12 is an explanatory view for explaining an operation of the machine of FIG. 9, and FIG. 13 is a plan view showing the relation between a manual sheet feed tray guide plate and guide plates.

Incidentally, the same constructural elements as those shown in FIGS. 4 and 5 are designated by the same reference numerals used in FIGS. 4 and 5, and the detailed explanation thereof will be omitted.

First of all, the arrangement showing the relation between the manual sheet feed and the feeding of the sheet used in the both-face/multiple copying operation, which forms a main part of this embodiment, will be explained with reference to FIGS. 9 and 12.

To reference numerals 121, 122 denote a pair of upper and lower rectangular guide plates which are arranged in parallel with each other and are pivotably mounted on a machine frame by means of a pair of left and right pin 125. The reference numeral 126 denotes a manual sheet feed tray guide which is fixed to the machine frame in such a manner that the surface of this guide is flush with a surface of a manual sheet feed tray 60 (FIG. 10). Following to the manual sheet feed tray guide 126, a lower guide 127 is fixed to the machine frame, and an upper guide 129 is also fixed to the machine frame above the lower guide 127.

Below the manual sheet feed tray guide 126 and the lower guide 127, a pressure arm 131 is pivotably mounted on pins 130 fixed to the machine frame. As shown in FIG. 12, the pressure arm 131 can be rocked upwardly and downwardly by means of an eccentric cam 132 driven by a stepping motor (not shown). A manual sheet feed driven roller 133 biased upwardly is mounted on the pressure roller 131 at its end (free end) remote from the pins 130, and lifting projections 135 are arranged on the free end of the pressure roller 131.

Sheet re-feeding drive rollers 136 are rotatably supported by the machine frame, which rollers can be energized and disenergized from a driving source (not shown) through a clutch. These sheet re-feeding drive rollers 136 protrude from openings 137 formed in the guide 122, and corresponding sheet re-feeding driven rollers 139 are arranged above the drive rollers 136 in confronting relation thereto and are formed integrally with shafts 140. Both ends of the shafts 140 are guided in slots 142 elongated in an up-and-down direction and formed in corresponding brackets 141 fixed to the guide plate 121. The shaft 140, and accordingly the driven rollers 139 are biased downwardly by means of springs 143. Further, the driven rollers 139 protrude downwardly from openings 145 formed in the guide plate 121. A roller release arm 146 having locking portions below the shafts 140 is pivotably supported by pins 147 fixed to the guide plate 121, and the other end **146*a* of the release arm 146 is abutted against the undersurface of a projecting lug 149 fixed to the machine frame. Further, manual sheet feed drive rollers 150 rotatably supported by the upper guide 129 and protruding downwardly from this upper guide can be rotated by means of a stepping motor (not shown), these drive rollers 150 being arranged in confronting relation to the manual sheet feed roller 133. Incidentally, an upright reference guide surface 157 for the manually introduced sheet 6 is formed at the right end of the manual sheet feed tray guide 126**.

A front end portion of the guide plate 121 is bent upwardly substantially at a right angle to form a shutter member 151, so that, when the manually introduced sheet 6 is abutted against the shutter member 151, the sheet is also contacts a sensor lever 152, thereby activating a photo-interrupter 153. Further, a sensor lever 155 for detecting the trailing edge of the sheet and an associated photo-interrupter 156 are also arranged in the upper guide 129.

In addition, a reflection-type photosensor 160 is arranged in a position spaced from the reference guide surface 157 by a distance greater than a pitch between the sheet re-feeding rollers 139 and 139'.

Incidentally, as shown in FIG. 12, when the both-face/multiple copying operation is performed, the manual sheet feed roller pairs 133, 135 are arranged in an area C through which the sheet S is passed. Borders of this area C are shown by a chain and dot lines D.

Next, a manual sheet feed operation will be explained.

Figure 12A:
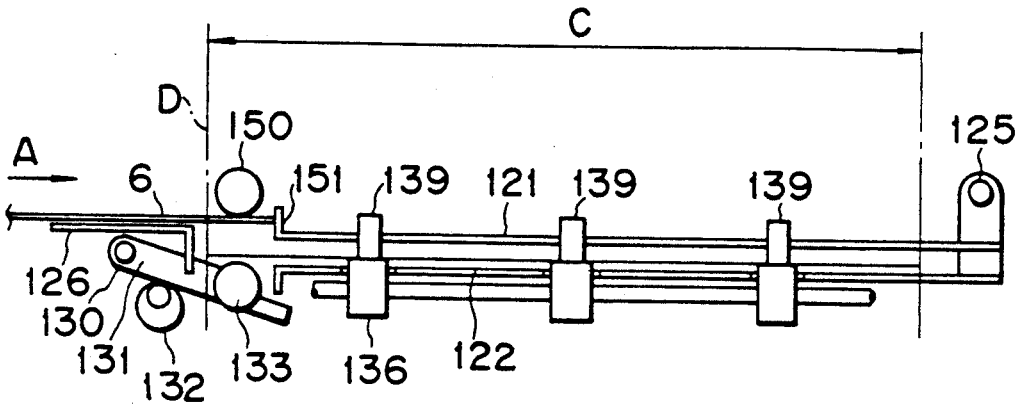
FIGS. 12A to 12C are explanatory views for explaining operation of guide plates.
Figure 12B:
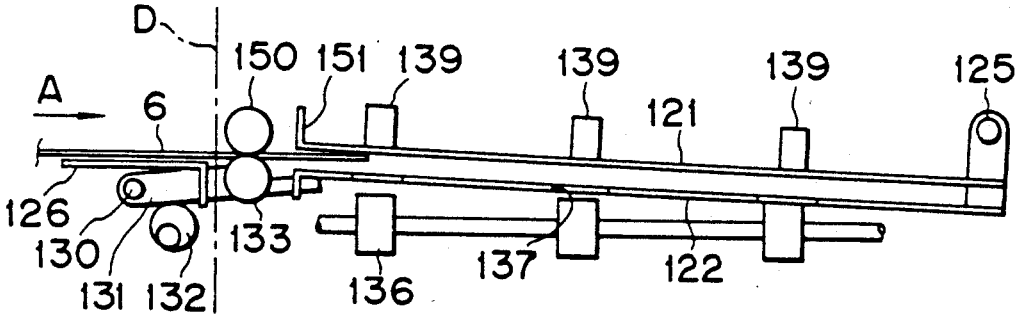
Figure 12C:
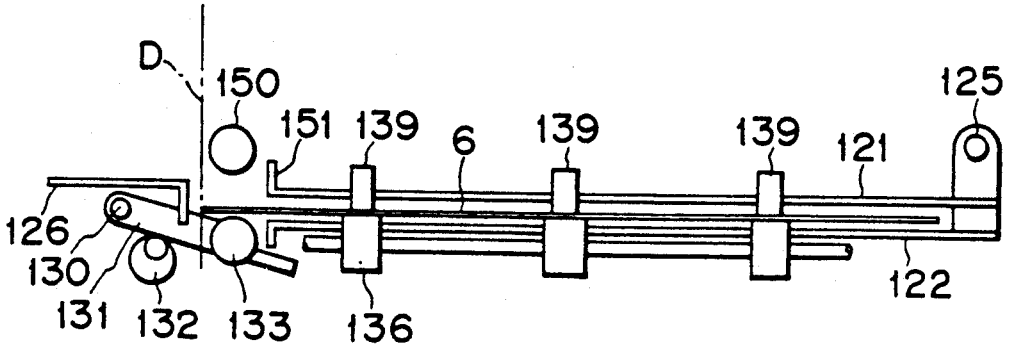
Figure 13:
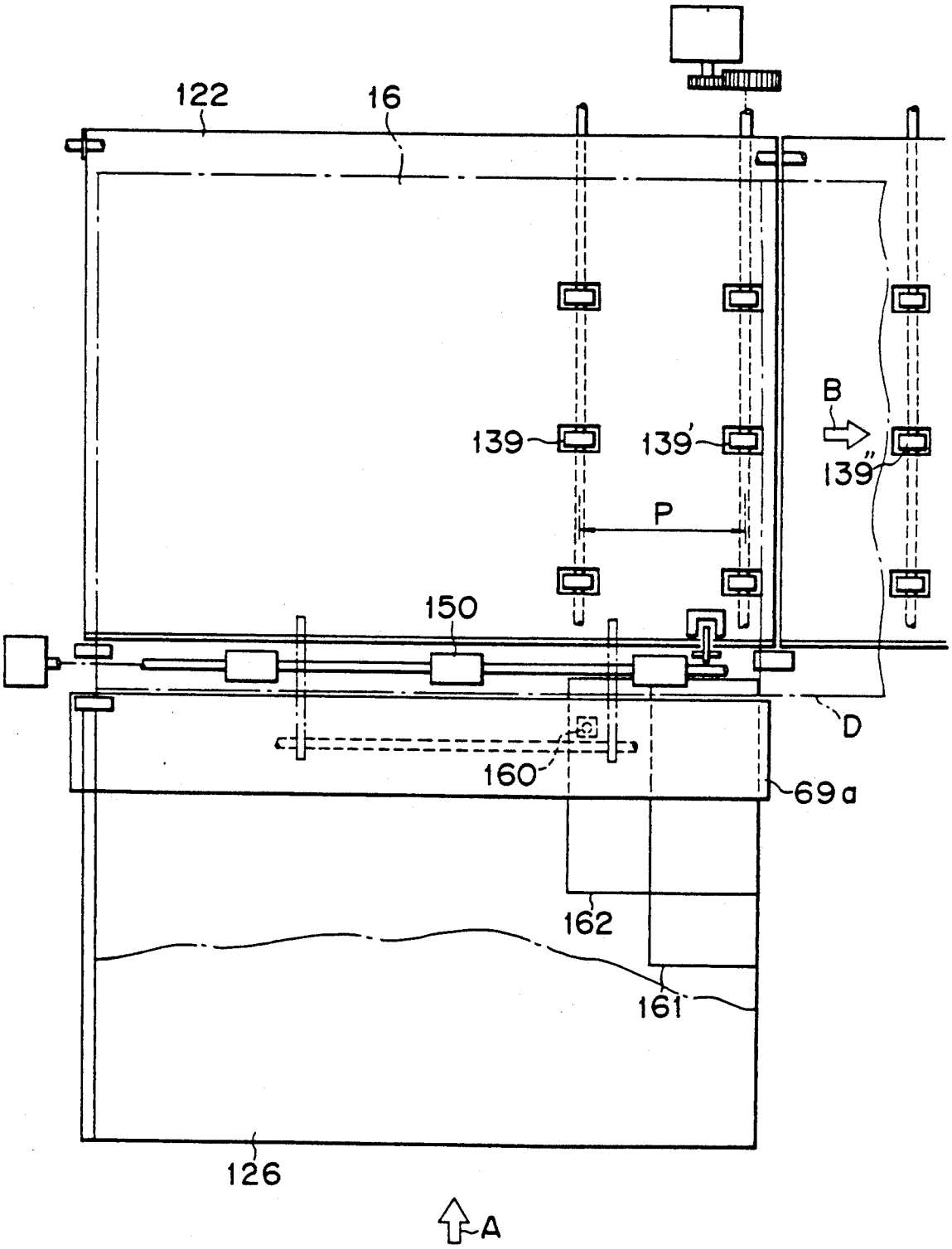
FIG. 13 is a plan view showing the relation between a manual sheet feed tray guide pate and guide plates.

As shown in FIG. 12A, when the both-face/multiple copying operation is being performed, the pressure arm 131 is lowered by the eccentric cam 132 in which an amount of eccentricity thereof is minimum, with the result that the left end portions of the guide plates 121, 122 supported by the lifting projections 135 arranged on the free end of the pressure arm 131 are positioned below the upper surface of the manual sheet feed tray guide 126 so that the shutter member 151 is positioned perpendicular to the surface of the manual sheet feed tray guide 126. In this position, the sheet re-feeding rollers 133, 136 perform the sheet re-feeding operation normally. That is to say, the manual sheet feed rollers 133, 150 situated in the area C through which the sheet 6 used in the both-face/multiple copying operation is passed are not interfered with the sheet 6 to be re-fed.

In the above condition, after it been determined that the both-face/multiple copying operation is not executed, the sheet 6 is introduced from the manual sheet feed inlet 2 along the reference guide surface 157 in the direction A until the sheet abuts against the shutter member 151. In this case, the detecting means comprising the sensor lever 152 and the photo-interrupter 153 is turned ON. If the sensor 160 is not turned OFF, it is judged that the inserted sheet 6 cannot be fed, thereby presenting an error message. Accordingly, the operator can stop the insertion of the sheet. When the error message is not emitted, that is to say, when the sheet 6 is wider as a sheet material, the sensor 160 is turned OFF, and the error message is not presented. In this case, the operator can provide a manual sheet feed start signal by depressing a button (not shown).

Then, by this signal, the controlling portion (not shown) rotates the eccentric cam about 180 degrees to lift the pressure arm 131. Consequently, the guide plates 121, 122 are rocked upwardly around the pins 125 by the lifting projections 135 (FIG. 9). Consequently, the upper surface of the guide plate 122 is positioned slightly below the upper surface of the lower guide 127 (in this case, the dimensions of the pressure arm 131 and of the eccentric cam 132 are selected that all of the sheet re-feeding rollers 136 are positioned below the upper surface of the guide plate 122), and the manual sheet feed roller 133 is pressed, due to the upward bias force applied thereto, against the manual sheet feed drive rollers 150 with the interposition of the manually inserted sheet 6 abutted against the shutter member 151, and the shutter member 151 is retarded upwardly together with the guide plate 121. At the same time, the other end **146*a* of the roller release arm 146 is locked by the projecting lug 149, and the opposite end of the roller release arm 146 is lifted upwardly, thereby lifting the shaft 140 in opposition to the downward bias forces of the springs 143, thus retarding the sheet re-feeding driven rollers 139 in a position above the lower surface of the guide plate 122**.

At the point that the eccentric cam 132 has been rotated about 180 degrees, a signal is emitted. In response to this signal, the controlling portion rotates the manual sheet feed drive rollers 150 to feed the manually introduced sheet 6 toward the right (direction A in FIG. 12) at a predetermined speed.

Then, when the sheet is fed by a predetermined amount after the trailing edge of the sheet 6 has been detected by the sensor lever 155 and the photointerrupter 156, the manual sheet feed rollers 133, 150 are stopped. By this movement of the sheet, the trailing edge of the sheet 6 is registered with the border line D of the area C.

Then, upon receipt of the signal representing the fact that the driving source for driving the manual sheet feed drive rollers 150 is stopped, the controlling portion energizes the driving source for the eccentric cam 132 to rotate the latter about 180 degrees, with the result that the pressure arm 131 is lowered, thereby restoring the condition shown in FIG. 12A. However, in this case, the sheet 6 is pinched between the sheet re-feeding rollers 136, 139.

Then, upon receipt of the signal representing the fact that the driving source for the eccentric cam 132 is stopped, the controlling portion activates the sheet re-feeding rollers 136, 139 to feed the manually introduced sheet 6 in a direction (Direction B) perpendicular to the manually inserting direction, and then, the sheet is fed by the re-feeding rollers 33 (FIG. 11) and the regist rollers 22 to the image forming area (including the photosensitive drum 42, fixing device 25 and the like).

As mentioned above, since any sheet other than particular size, having a dimension smaller than the pitch P (FIG. 13) between the re-feeding rollers 139 in the sheet re-feeding path 30 for the both-face/multiple copying operation can not be fed in the re-feeding path 30, such sheet is detected by the sensor 160 to inform the operator of the abnormal sheet. Accordingly, by stopping the manually introducing operation, the jamming of the sheet can be prevented.

Incidentally, when received the error message from the sensor 160, in place of the fact that the operator stops the manually introducing operation, the driving circuit may be automatically turned OFF not to activate the manual sheet feed drive rollers 150.

Next, a further embodiment shown in FIGS. 14 and 15 will be explained. In this embodiment, since the arrangement wherein the sheet re-feeding path 30 for the both-face/multiple copying operation is arranged in the copying machine in a position slightly below the upper surface of the manual sheet feed tray and extends in a direction perpendicular to the manual sheet feed tray is the same as the arrangements of FIGS. 5 and 11, the detailed explanation of such arrangement will be omitted.

A guide plate 209 for making up the lacked portion of the feeding path 30 when it is in a horizontal position is pivotably mounted on pins 210 fixed to the machine frame through brackets **210*a*, and a guide plate 211 is spaced above the guide plate 209 by a predetermined distance and is integrally attached to the guide plate 209 in parallel thereto. A front end of the guide plate 211 is bent upwardly at a right angle to form a shutter member 211*a***.

A plurality of feeding drive rollers 212 are mounted on a rotary shaft **212*a* in parallel with the copying machine and in perpendicular to the feeding path 30. These rollers 212 can be rotated by a motor 213 through the rotary shaft 212*a* and protrude upwardly from openings formed in the guide plate 209. A plurality of pressure rollers 215 are arranged on the guide plate 211 in confronting relation to the drive rollers 212. The pressure rollers 215 protrude downwardly from openings formed in the guide plate 211 to be pressed against the drive rollers 212. When the guide plates 209, 211 are inclined around the pins 211, the drive rollers 212 is positioned below the upper surface of the guide plate 209 and the pressure rollers 215 are held in the openings of the guide plate 211 in the condition that the pressure rollers 215 slightly protrude downwardly from the bottom surface of the guide plate 211, whereby a clearance is maintained between the lowermost portions of the pressure rollers 215 and the upper surface of the guide plate 209** for passing the sheet P therethrough without trouble.

While this method for retarding the pressure rollers 215 is a simplest method, other methods may be adopted. For example, a method for lifting a shaft **215*a* of the pressure rollers 215 with respect to the guide plate 211 by means of a solenoid may be used, or a method for lifting the roller shaft 215*a* by an end of a lever pivotably mounted on the machine frame when an intermediate portion of the lever is lifted by the lifted guide plate 211** may be used.

Further, at the left side of the guide plates 209, 211, reflection-type photosensors 216, 217, 218, 219 and 220 are arranged in positions spaced from a feed reference line C by distances corresponding to the dimensions of postcard, B5 size sheet, B5-R size sheet A4 (A3-R) size sheet, and A4-R size sheet, respectively.

Further, a manual sheet feed drive rollers 223 are rotatably supported by an arm 222 pivotably mounted on pins 221 fixed to the machine frame, in a position rightwardly (FIG. 15) of the feed reference line C. These drive rollers 223 is rotatingly driven by a motor 225. A plurality of pressure rollers 226 are attached to the manual sheet feed tray 126 in confronting relation to the drive rollers 223. An eccentric cam 227 for rocking the arm 222 around the pins 221 is fixed to a rotary shaft 229 driven by an appropriate driving source (not shown).

The reference numeral **69*a* denotes a guide for guiding the right edge of the manually introduced sheet P. Detecting sensors 231 are arranged on both sides of the rear end of the manual sheet feed tray 126, and a detecting sensor 232 is arranged forwardly of the manual sheet feed rollers 223, 226. Further, a reflection-type photosensor 233 is arranged on an upper guide 203*a* of the manual sheet feed tray 126**.

Figure 16A:
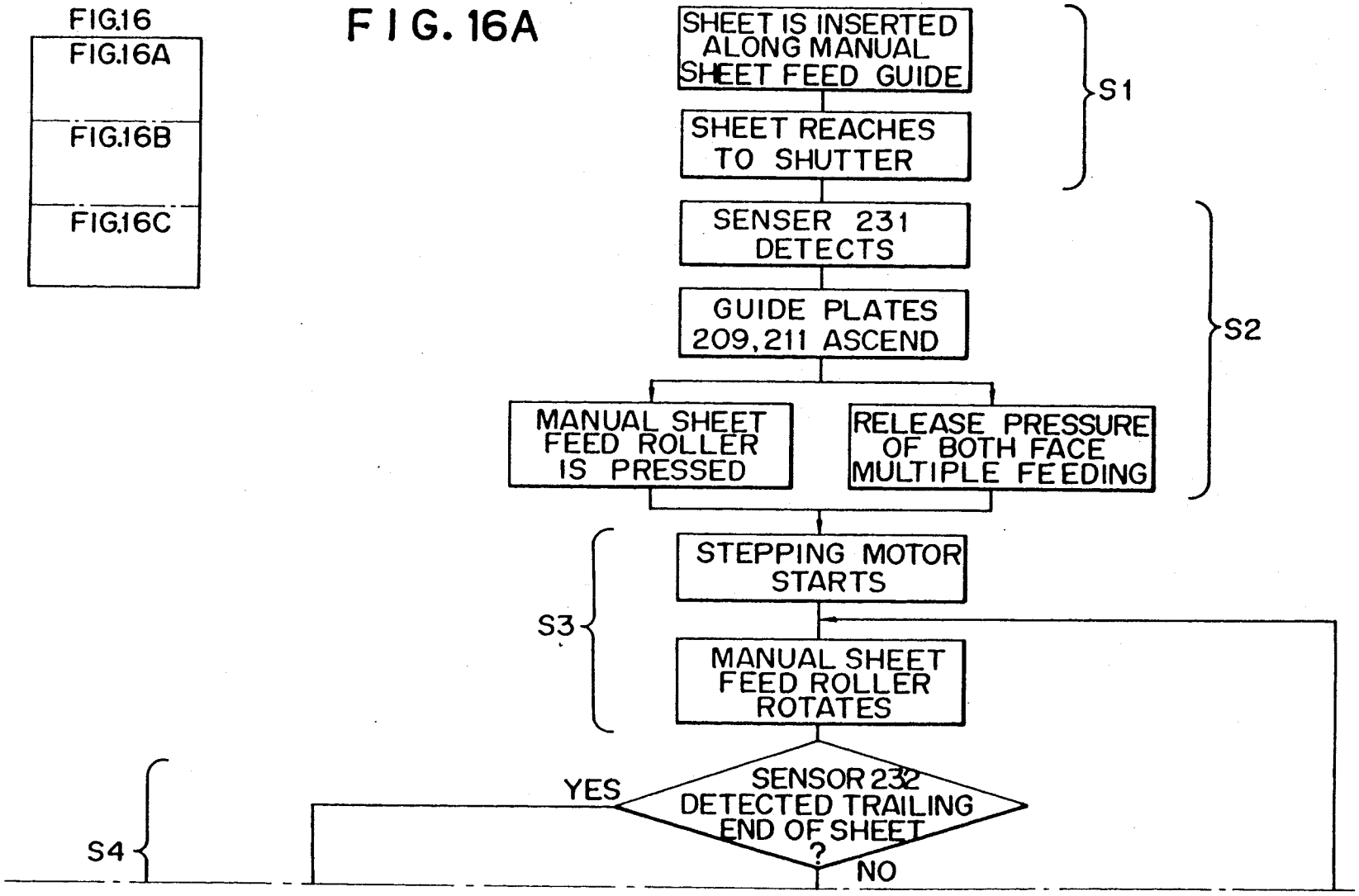
FIG. 16 is a flow chart.
Figure 16B:
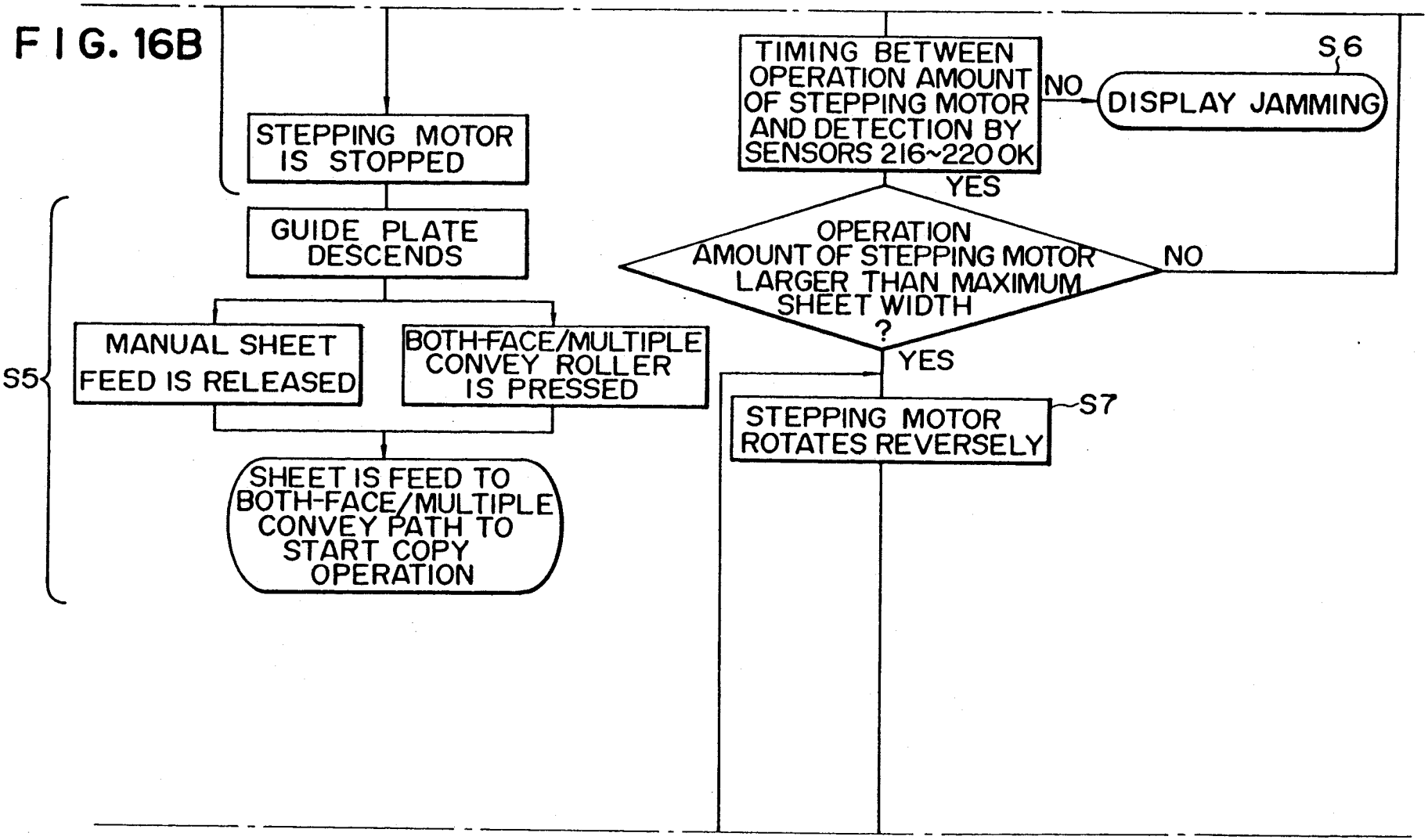
Figure 16C:
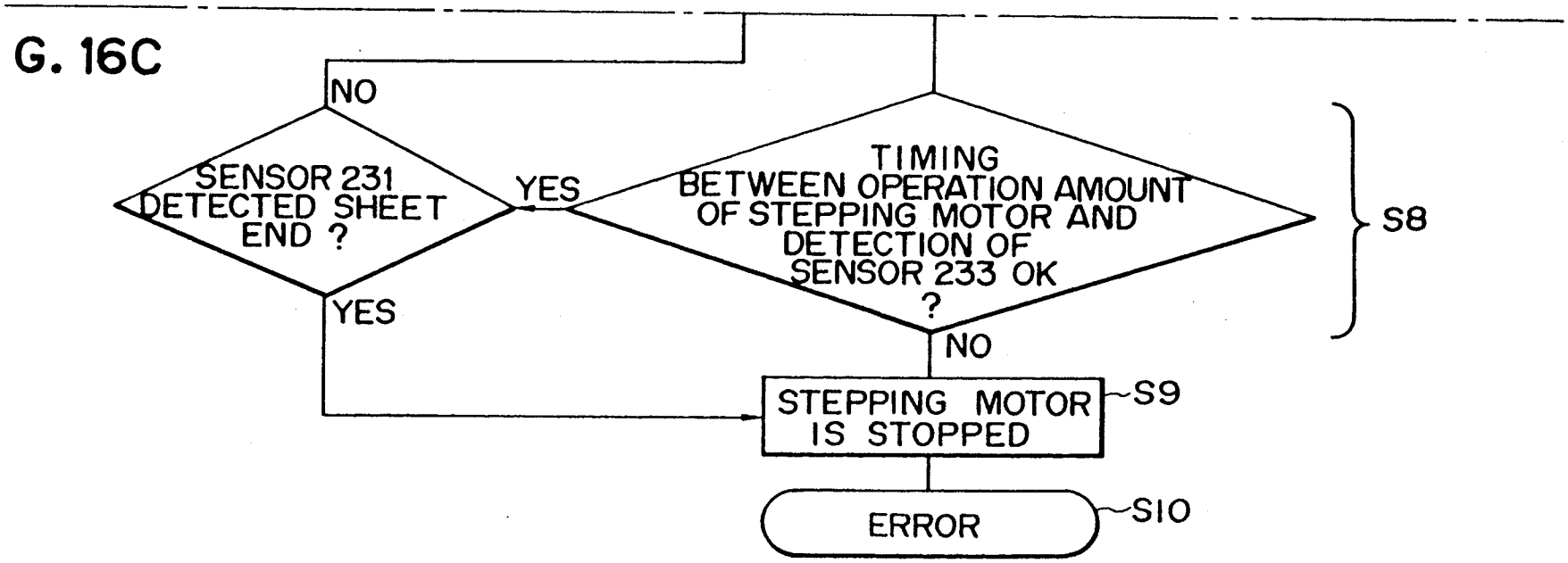
Figure 17:
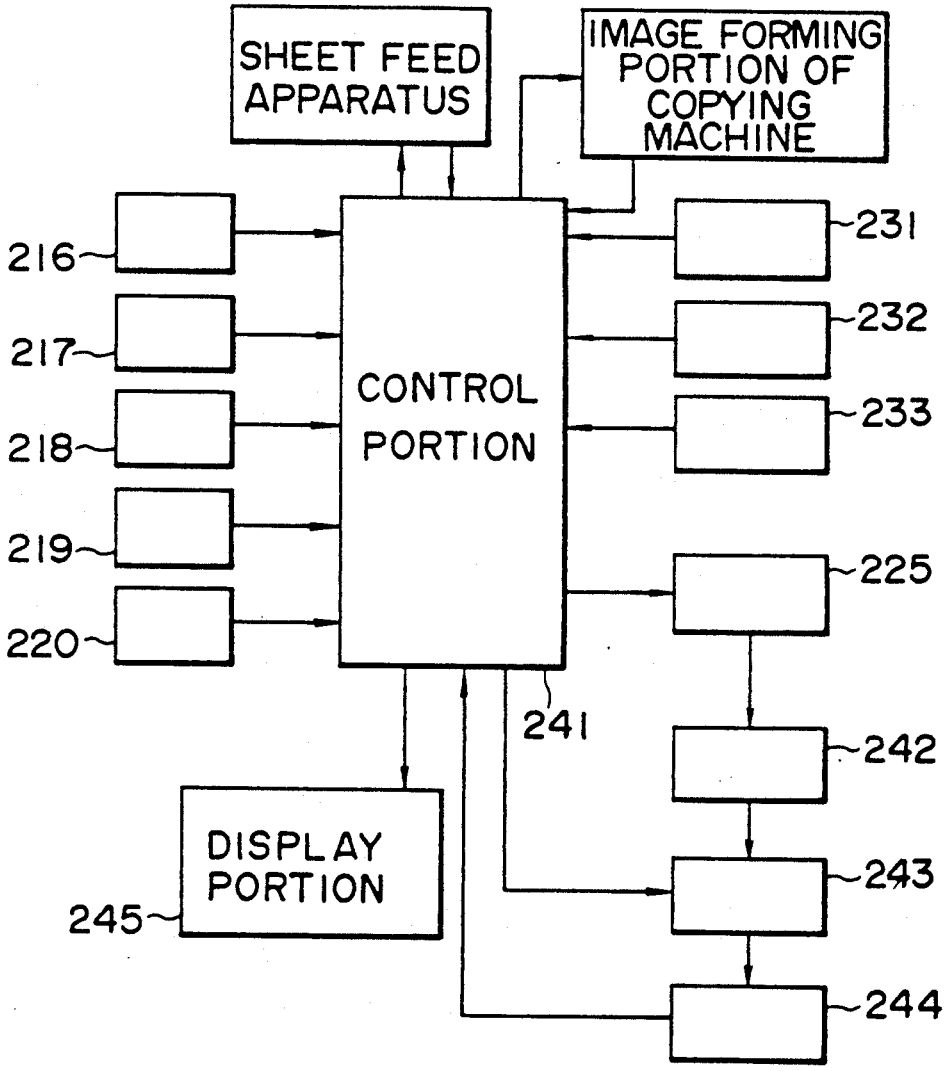
FIG. 17 is a control brock diagram.

Next, an operation of the copying machine according to this embodiment will be explained in connection with a flow chart shown in FIG. 16.

First of all, the operator inserts the sheet P manually along the manual sheet feed guide **69*a* until the leading edge of the sheet P reaches the shutter member 211*a*** (step $S_1$).

Substantially at the same time, when the sheet P is detected by the sensor 231, in response to the signal from this sensor, the eccentric cam 227 is rotated by the motor (not shown) by 180 degrees, and then is stopped. As a result, the arm 222 is rotated around the pins 221 in an anti-clockwise direction (FIG. 15) by the rotation of the cam 227. Consequently, the end **222*a* of the arm 222 is engaged by the end 209*a* of the guide plate 209, thereby registering the guide plates 209, 211 with the upper surface of the manual sheet feed tray 126 and retarding the feed rollers 212, 215 to permit the movement of the sheet P onto the upper surface of the guide plate 209. At the same time, the manual sheet feed rollers 223, 226 are pressed against each other. That is to say, the copying machine is changed from the condition shown in FIG. 15A to the condition shown in FIG. 15**B (step $S_2$).

When the motor for driving the eccentric cam 227 is stopped, the signal is emitted, by which the stepping motor 225 is activated to rotate the manual sheet feed rollers 223, 226, thereby feeding the sheet P (step $S_3$).

Then, when the detecting sensor 232 detects the trailing end of the sheet P, the stepping motor 225 is rotated by a predetermined number of pulses to register the trailing end of the sheet P with the reference line C, and then is stopped. In this point, the copying machine occupies the condition shown in FIG. 15D (step S).

When the sensor 232 detects the trailing end of the sheet P and emits the signal, in response to this signal, the eccentric cam 227 is rotated by 180 degrees to lower the arm 222, thereby lowering the guide plates 209, 211 (in the position shown in FIG. 15A) to press the feed rollers 212, 215 against each other and release the engagement between the manual sheet feed rollers 223, 226. Thereafter, the sheet P is fed to the re-feeding path 30 for the both-face/multiple copying operation by means of the rollers 212, 215, and the image forming operation (copying operation) is started (step $S_5$). Further, if the next manual sheet feed is desired, the sequence is repeated from the step $S_1$.

This is a normal feeding condition for the sheet P.

The number of pulses of the stepping motor 225 is counted from the start thereof by a counter 242 so that the feeding amount of the sheet P is measured. By comparing the counted value of the counter with the timings when the sheet is detected by the sensors 216–220 by means of a comparison circuit 243, it is judged whether the sheet is normally fed or not in a discrimination circuit 244. If the operation amount of the stepping motor 225 does not coincide with the timings of the detection signals of the sensors 216–220, the controlling portion 241 causes a display portion 245 to display a JAM indication and stops all of the operations.

If the trailing end of the sheet P is not detected by the sensor 232 even after the feeding amount of the sheet P (operation amount of the stepping motor 225) has reached the amount corresponding to the dimension of the largest size (AS-R) sheet, by comparing these amounts in the comparison circuit 243, the controlling portion 241 judges that the sheet being fed has the abnormal size, and rotates the stepping motor 225 in the reverse direction (step $S_7$).

While the motor 225 is rotated reversely to feed the sheet P back, when the operation amount of the motor 225 coincides with the detection timing of the sensor 233 (sensor 233*a* in case of the small size sheet, or sensor 233*b* in case of the large size sheet) and the trailing end of the sheet P is detected by the sensor 231 (step $S_8$), the motor 255 is stopped, thus completing the feeding-back of the sheet P (step $S_9$). However, in this case, since the sheet having the abnormal size is introduced, the error indication is displayed on the display portion (step $S_{10}$).

If the detection timing of the sensor 233 does not coincide with the operation amount of the stepping motor 255 (i.e., if the leading edge of the sheet P does not reach the sensor 233 after the stepping motor 255 has been rotated by a predetermined time), it is judged that the jamming of the sheet occurs during the feeding-back of the sheet, and the stepping motor 255 is stopped immediately, and all of the operations are stopped, and the error indication (indication of the abnormal size sheet and of the occurrence of the jamming) is displayed on the display portion (step $S_{10}$).

Figures 15A, 15B, 15C:
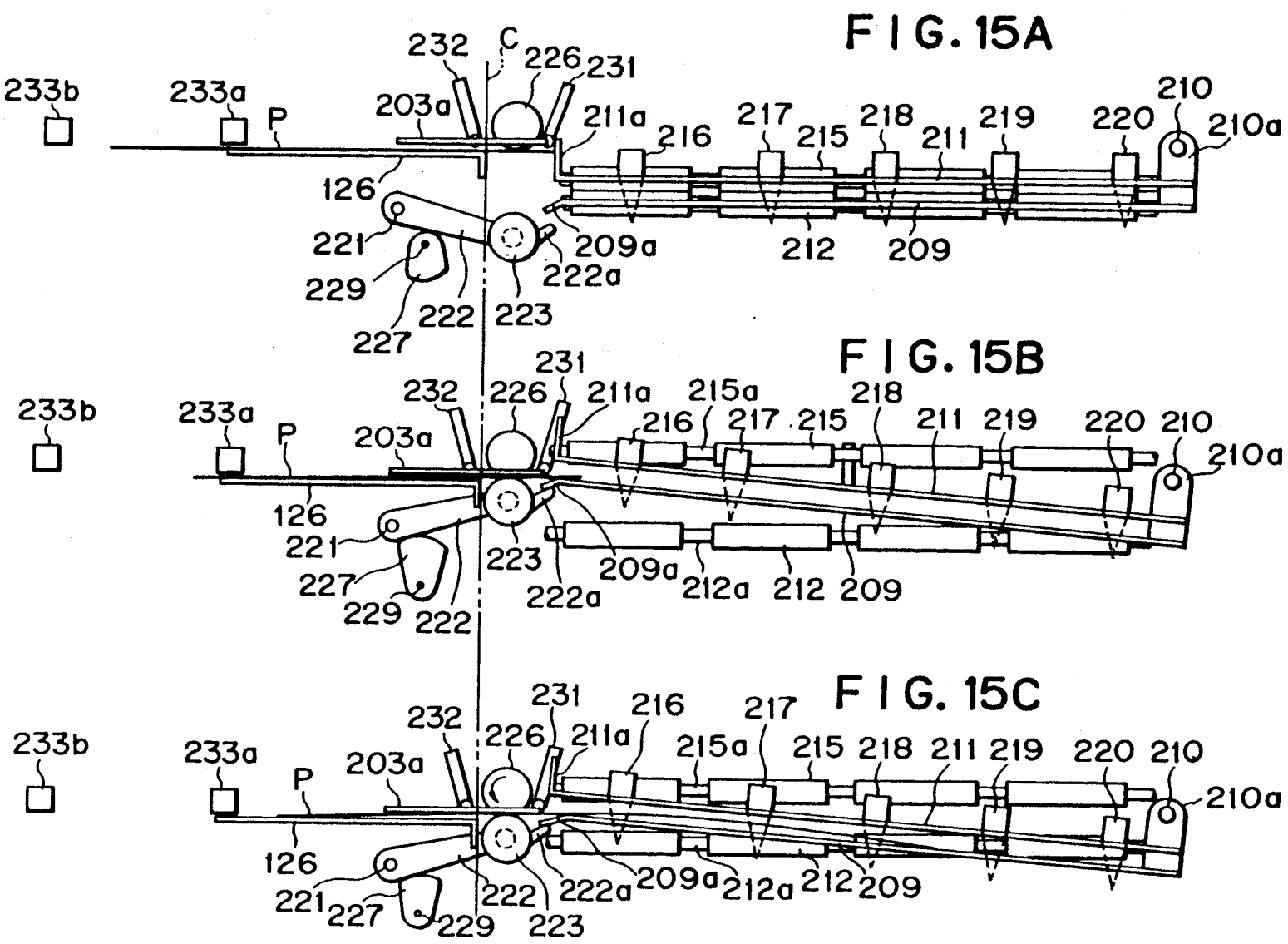
FIGS. 15A to 15E are explanatory views for explaining an operation of the device of FIG. 14.
Figure 15D:
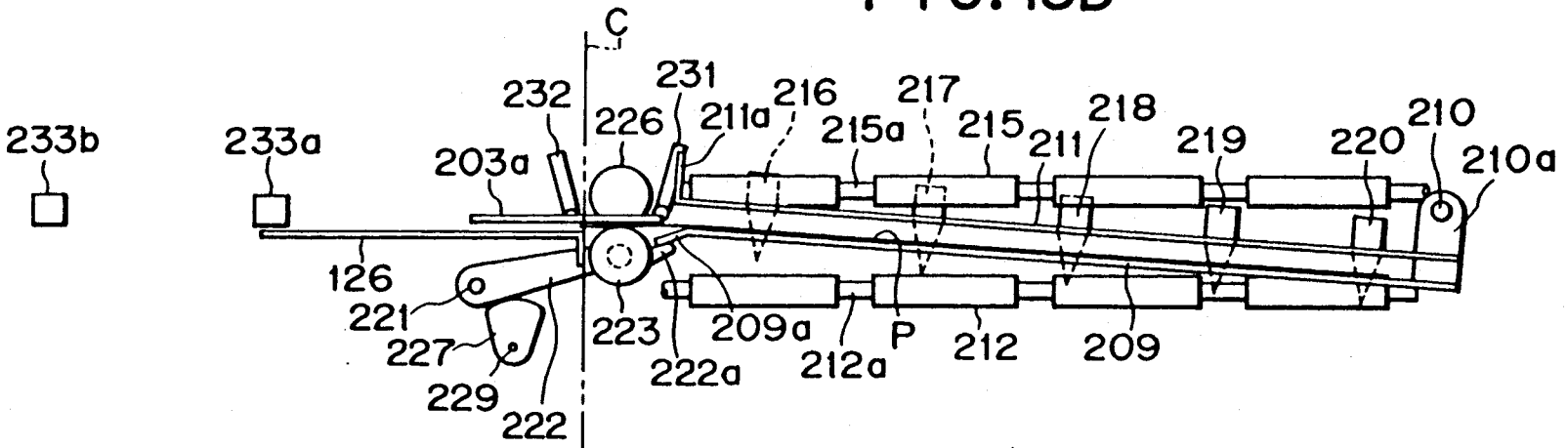

In the case where the jamming is indicated (step $S_6$) and the error is indicated (step $S_{10}$), when the jammed sheet is removed, the copying machine restores the condition shown in FIG. 15A, and the sequence is repeated from the step $S_1$.

Figure 15E:
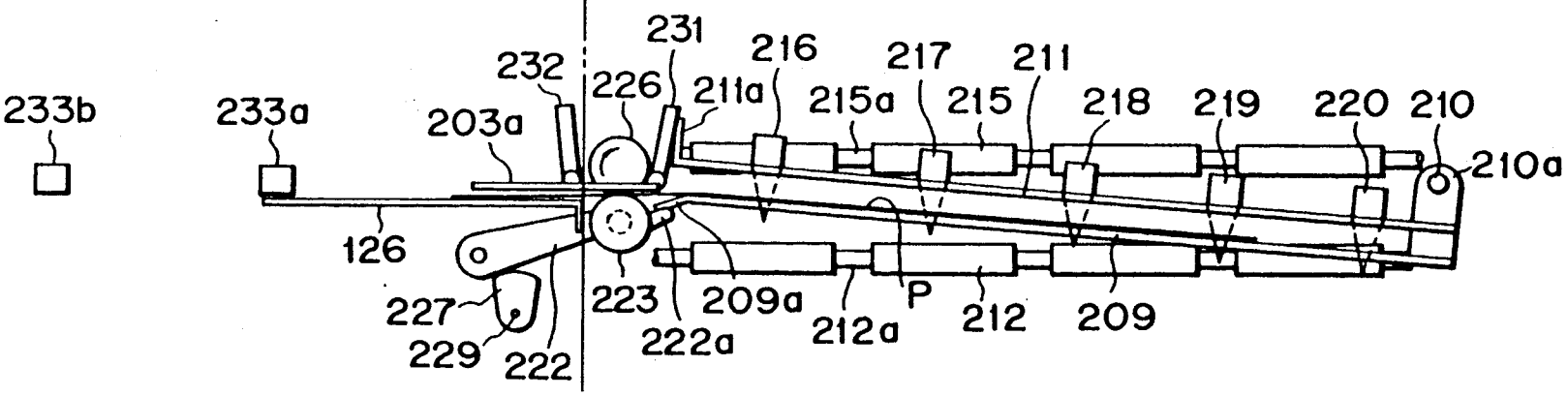

Incidentally, FIG. 15A shows the condition that the sheet P is being inserted, and FIG. 15E shows the condition that the largest size sheet P is being fed back.

Further, the sensor 233*a* is so situated that trailing end of the inserted small size sheet can pass through this sensor without fail and the trailing end of this sheet can encounter with this sensor during the feeding-back of the sheet. The sensor 233*b* is similarly situated with respect to the large size sheet.

Next, the other embodiment of the present invention will be explained with reference to FIG. 18.

Figure 18:
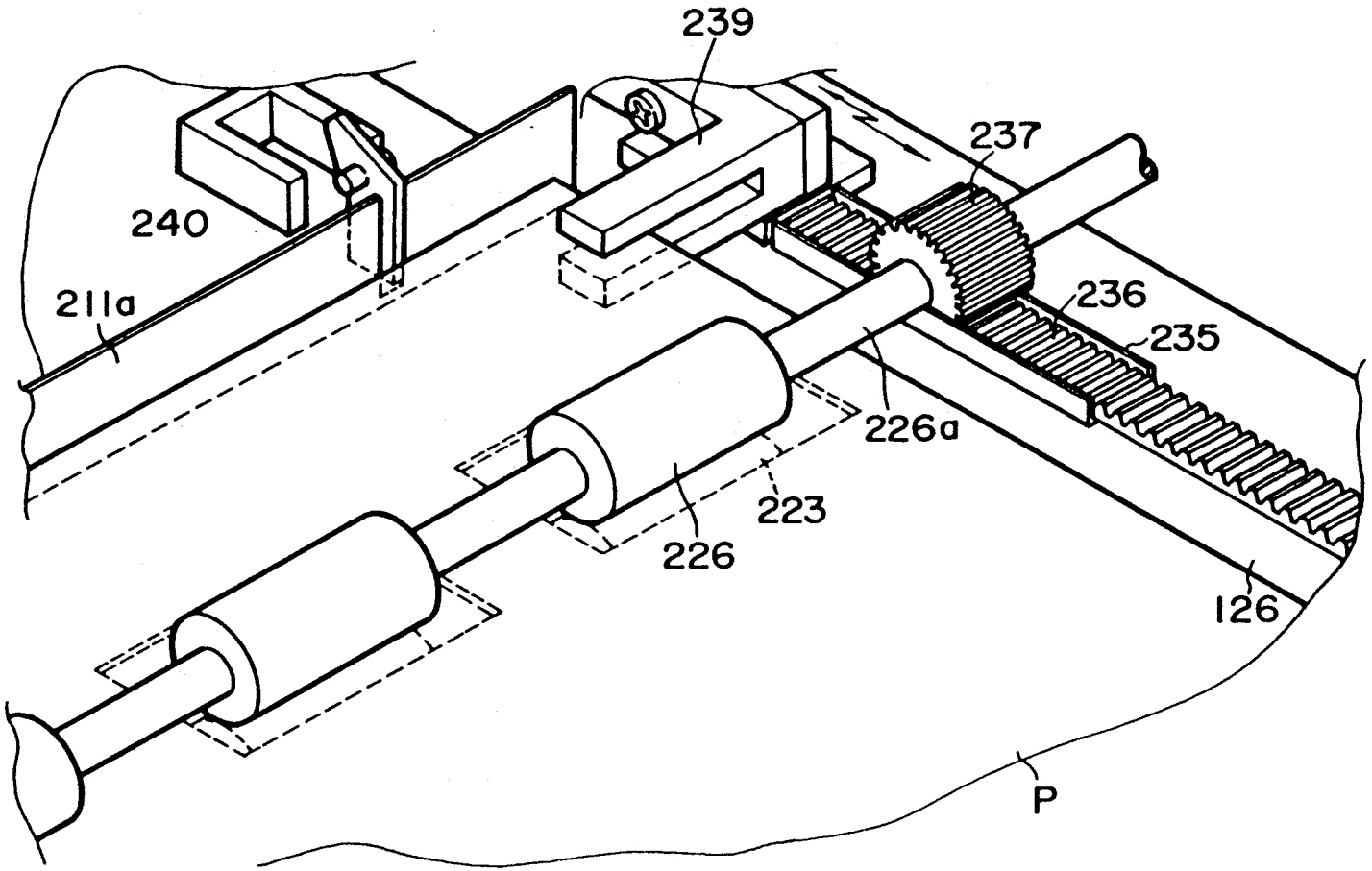
FIG. 18 is a perspective view of an image forming apparatus according to the other embodiment of the present invention.

While, in the above-mentioned embodiment, the present invention was applied to the sheet having the particular size such as post card size, B5 size, B5-R size A4 (A3-R) size, and A4-R size, in the embodiment shown in FIG. 18, even when the sheet having no particular size is manually inserted, the abnormity of the sheet can be detected.

At the right end of the manual sheet feed tray 126, a rail 235 is arranged to extend in the manual sheet feeding direction, and a rack 236 is slidably mounted on the rail 235. A pinion 237 having a pitch circle of the same diameter as those of the pressure rollers 226 is fixed on the roller shaft 226*a* of the pressure rollers 226 in confronting relation to the rack 236. The pinion 237 is meshed with the rack 236. A photo-interrupter 239 is attached to the end of the rack 236 to be moved together with the rack 236. Further, a sensor 240 for detecting the leading end of the sheet P is attached to the shutter member 211*a*.

Accordingly, when the sheet P is manually inserted into the manual sheet feed tray 126 until it abuts against the shutter member 211*a*, the sensor 240 is turned ON and the photo-interrupter 239 is also turned ON. By the signal emitted from the sensor, the manual sheet feed rollers 223 are driven together with the pressure rollers 226, and the sheet P and the rack 236 are moved in the same speed.

In this case, when the abnormity in the movement of the sheet P occurs, the sheet P is deviated from the rack 236 forwardly, thus turning the photo-interrupter 239 ON.

The signal from the photo-interrupter is sent to the controlling portion 241, and the latter judges that the jamming of the sheet occurs. Consequently, the stepping motor 225 is stopped, and then is rotated reversely. The manual sheet feed rollers 223 and the pressure rollers 226 are also rotated reversely to feed the sheet back. The further operation will be effected in the same manner as mentioned above.

We claim:

1. An image forming apparatus having an image forming portion, means for feeding a sheet material to said image forming portion, and a re-feeding path for re-feeding the sheet on which an image is formed at said image forming portion to said image forming portion again, comprising:

a manual sheet feed inlet formed in the front side of said image forming apparatus;

a manual sheet insertion path for directing a sheet material manually inserted into said manual sheet feed inlet to said re-feeding path, said manual sheet insertion path being arranged substantially perpendicular to said re-feeding path; and a feeding means for feeding the manually inserted sheet material directed to said re-feeding path to said image forming portion.

2. An image forming apparatus according to claim 1, wherein said feeding means is retracted in a position where said feeding means does not interfere with the insertion of the sheet material when the sheet material is manually inserted.

3. An image forming apparatus according to claim 2, wherein said manual sheet insertion path includes a rotary member for feeding the sheet material.

4. An image forming apparatus according to claim 3, wherein said rotary member in said manual sheet insertion path is retracted so as not to interfere with the insertion of the sheet material when said re-feeding path is used for a re-feeding purpose.

5. An image forming apparatus according to claim 1, further including a manual sheet size detecting means for detecting whether the manually inserted sheet is a minimum feedable size, said detecting means being arranged in said manual sheet insertion path.

6. An image forming apparatus according to claim 1, further including a manual sheet size detecting means arranged in said manual sheet insertion path for detecting a size of the manually inserted sheet material, and a control means for controlling feeding of the manually inserted sheet back to said manual sheet feed inlet when the size of the sheet material is improper, on the basis of a signal from said manual sheet size detecting means.

7. An image forming apparatus according to claim 6, further including means for stopping the feeding-back operation of the sheet material when an abnormity occurs during the feeding-back of the sheet material.

8. An image forming apparatus according to claim 7, wherein said manual sheet size detecting means is arranged along said manual sheet insertion path.

9. An image forming apparatus according to claim 1, further including:

means for counting an amount of movement of the manually inserted sheet material;

means for successively detecting arrivals of the manually inserted sheet materials, arranged along said manual sheet insertion path; and means for judging the normal condition or abnormal condition of the manually inserted sheet by comparing a counted value from said counting means with a signal from said detecting means.

10. An image forming apparatus according to claim 1, further including:

first means for detecting a leading end of the manually inserted sheet material, arranged in the further portion of said manual sheet insertion path;

second means for detecting a trailing end of the manually inserted sheet material, arranged in the nearer portion of said manual sheet insertion path; and means for judging an abnormity of the sheet size when said second means does not detect the trailing end of the manually inserted sheet material after said first means has detected the leading end of said manually inserted sheet material.

11. An image forming apparatus having an image forming portion, means for feeding a sheet material to said image forming portion, and a feeding path for feeding the sheet on which an image is formed at said image forming portion, comprising:

a manual sheet feed inlet formed in the front side of said image forming apparatus;

a manual sheet insertion path for directing a sheet material manually inserted into said manual sheet feed inlet, said manual sheet insertion path being arranged substantially perpendicular to said feeding path;

a feeding means for feeding the manually inserted sheet material inserted into said manual sheet feed inlet to said image forming portion in a direction substantially perpendicular to said manual sheet insertion path;

a detecting means for detecting a size of the sheet material;

a judging means for judging whether an improper sheet material is inserted, by comparing the size of the sheet material detected by said detecting means with a minimum feedable size of the sheet material fed by said feeding means.

12. An image forming apparatus having an image forming portion, means for feeding a sheet material to said image forming portion, and a feeding path for feeding the sheet on which an image is formed at said image forming portion, comprising:

a manual sheet feed inlet formed in the front side of said image forming apparatus;

a manual sheet insertion path for directing a sheet material manually inserted into said manual sheet feed inlet, said manual sheet insertion path being arranged substantially perpendicular to said feeding path;

a feeding means for feeding the manually inserted sheet material inserted into said manual sheet feed inlet to said image forming portion in a direction substantially perpendicular to said manual sheet insertion path;

a detecting means for detecting a size of the sheet material; and a control means for feeding the sheet material back, when an improper sheet material is inserted, by comparing the size of the sheet material detected by said detecting means with a maximum feedable size of the sheet material fed by said feeding means.

13. An image forming apparatus having an image forming portion, means for feeding a sheet material to said image forming portion, and a feeding path for feeding the sheet on which an image is formed at said image forming portion, comprising:

a manual sheet feed inlet formed in the front side of said image forming apparatus;

a manual sheet insertion path for directing a sheet material manually inserted into said manual sheet feed inlet, said manual sheet insertion path being arranged substantially perpendicular to said feeding path;

a feeding means for feeding the manually inserted sheet material inserted into said manual sheet feed inlet to said image forming portion in a direction substantially perpendicular to said manual sheet insertion path;

a first means for detecting a leading end of the manually inserted sheet material, arranged in the rear or outlet portion of said manual sheet insertion path;

a second means for detecting a trailing end of the manually inserted sheet material, arranged in the front or inlet portion of said manual sheet insertion path; and means for judging abnormity of the sheet size when said second means does not detect the trailing end of the manually inserted sheet material after said first means has detected the leading end of the manually inserted sheet material.

14. An image forming apparatus having an image forming portion, means for feeding a sheet material to said image forming portion, and a feeding path for feeding the sheet on which an image is formed at said image forming portion, comprising:

a manual sheet feed inlet formed in the front side of said image forming apparatus;

a manual sheet insertion path for directing a sheet material manually inserted into said manual sheet feed inlet, said manual sheet insertion path being arranged substantially perpendicular to said feeding path;

a feeding means for feeding the manually inserted sheet material inserted into said manual sheet feed inlet to said image forming portion in a direction substantially perpendicular to said manual sheet insertion path;

means for counting an amount of movement of the manually inserted sheet material;

means for successively detecting arrivals of the manually inserted sheet materials, arranged along said manual sheet insertion path; and means for judging the normal condition or abnormal condition of the manually inserted sheet by comparing a counted value from said counting means with a signal form said detecting means.

15. An image forming apparatus having an image forming portion, means for feeding a sheet material to said image forming portion, and a feeding path for feeding the sheet on which an image is formed at said image forming portion, comprising:

a manual sheet feeding inlet formed in the front side of said image forming apparatus;

a manual sheet insertion path for directing a sheet material manually inserted into said manual sheet feed inlet, said manual sheet insertion path being arranged substantially perpendicular to said feeding path;

a feeding means for feeding the manually inserted sheet material inserted into said manual sheet feeding inlet to said image forming portion in a direction substantially perpendicular to said manual sheet insertion path;

an openable cover for normally closing the inlet, said cover also functioning as a manual sheet guide plate in the openable state thereof.

16. An image forming apparatus having an image forming portion, means for feeding a sheet material to said image forming portion, and a feeding path for feeding the sheet on which an image is formed at said image forming portion, comprising:

a manual sheet feed inlet formed in the front side of said image forming apparatus;

a manual sheet insertion path for directing a sheet material manually inserted into said manual sheet feed inlet, said manual sheet insertion path being arranged substantially perpendicular to said feeding path;

a feeding means for feeding the manually inserted sheet material inserted into said manual sheet feed inlet to said image forming portion in a direction substantially perpendicular to said manual sheet insertion path;

an openable cover for normally closing the inlet, said cover also functioning as a manual sheet guide in the opened state thereof;

a cassette inlet formed in the front side of said image forming apparatus;

a cassette insertion path for directing the cassette inserted into said inlet, said insertion path being arranged substantially perpendicular to said feeding path; and a feeding means for feeding the inserted sheet material inserted into said inlet by the cassette to said image forming portion in a direction substantially perpendicular to said insertion path.

* * * * *

UNITED STATES PATENT AND TRADEMARK OFFICE

CERTIFICATE OF CORRECTION

PATENT NO. : 5,043,770 Page 1 of 2

DATED : August 27, 1991

INVENTOR(S) : Toshiyuki Nagano et al.

It is certified that error appears in the above-identified patent and that said Letters Patent is hereby corrected as shown below:

On the title page, Item [56] References Cited:

Under "U.S. PATENT DOCUMENTS" heading, "Itmori" should read --Iimori--.

COLUMN 1:

Line 11, "relayes" should read --relates--.

COLUMN 2:

Line 66, "abnor-" should read --abnormality--; and
Line 67, "mity" should be deleted.

COLUMN 3:

Line 32, "pate" should read --plate--;
Line 38, "brock" should read --block--; and
Line 54, "the," should read --the--.

COLUMN 5:

Line 60, "perform" should read --to perform--.

COLUMN 7:

Line 8, "To" should read --Two--;
Line 16, "to" should be deleted; and
Line 64, "is" should be deleted.

UNITED STATES PATENT AND TRADEMARK OFFICE

CERTIFICATE OF CORRECTION

PATENT NO. : 5,043,770 Page 2 of 2

DATED : August 27, 1991

INVENTOR(S) : Toshiyuki Nagano et al.

It is certified that error appears in the above-identified patent and that said Letters Patent is hereby corrected as shown below:

COLUMN 10:

Line 7, "is" should read --are--;
Line 32, "a" should be deleted; and
Line 36, "is" should read --are--.

COLUMN 11:

Line 47, "(AS-R)" should read --(A5-R)--.

COLUMN 13:

Line 37, "abnormity" should read --abnormality--; and
Line 61, "abnormity" should read --abnormality--.

COLUMN 15:

Line 3, "abnormity" should read --abnormality--; and
Line 33, "form" should read --from--.

Signed and Sealed this

Thirtieth Day of March, 1993

*Attest:*

STEPHEN G. KUNIN

*Attesting Officer* *Acting Commissioner of Patents and Trademarks*